US009863146B2

(12) United States Patent
Bogh et al.

(10) Patent No.: US 9,863,146 B2
(45) Date of Patent: Jan. 9, 2018

(54) STRUCTURAL PANEL SYSTEMS WITH A NESTED SIDELAP AND METHOD OF SECURING

(71) Applicant: NUCOR CORPORATION, Charlotte, NC (US)

(72) Inventors: Brian Hansen Bogh, Yucaipa, CA (US); Christopher Lawrence Brown, Whittier, CA (US); Jeffrey Reino Martin, Fremont, CA (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 15/153,460

(22) Filed: May 12, 2016

(65) Prior Publication Data

US 2016/0333584 A1 Nov. 17, 2016

Related U.S. Application Data

(60) Provisional application No. 62/161,710, filed on May 14, 2015.

(51) Int. Cl.
*E04C 2/32* (2006.01)
*E04D 3/365* (2006.01)
(Continued)

(52) U.S. Cl.
CPC ..... *E04C 2/32* (2013.01); *E04B 5/40* (2013.01); *E04C 2/08* (2013.01); *E04C 2/322* (2013.01);
(Continued)

(58) Field of Classification Search
CPC ..... E04D 3/362; E04D 3/30; E04D 3/365; E04C 2/08; E04C 2/30; E04C 2/32; E04C 2/322; E04C 2/326
See application file for complete search history.

(56) References Cited

U.S. PATENT DOCUMENTS 107,290 A 9/1870 Renolds
182,193 A 9/1876 Holeton
(Continued)

FOREIGN PATENT DOCUMENTS

CN 202053595 U 11/2011
CN 202108134 U 1/2012
(Continued)

OTHER PUBLICATIONS

International Search Report and Written Opinion completed on Jul. 23, 2016.

*Primary Examiner* — Andrew J Triggs
(74) *Attorney, Agent, or Firm* — Moore & Van Allen PLLC; Jeffrey R. Gray

(57) ABSTRACT

The invention relates to structural panel systems with at least a four-layered generally in-plane sidelap, at least a three layer generally in-plane sidelap, or corner sidelaps of various layers, and methods for manufacturing and assembling structural panel systems with these types of sidelaps. The structural panels may be provided with an edge having a "lower lip" with two layers, and an opposite edge having an "upper lip" with two layers. Individual panels may be coupled together by placing the upper lip of a first panel over the lower lip of an adjacent panel, thus creating an un-joined sidelap. The lips may have nested portions for helping to place one lip over the other. The panels may be operatively coupled through various couplings configurations, such as fasteners, welding, cutting the sidelap, or the like. The present invention improves the shear strength of the structural panel system and reduces costs.

18 Claims, 15 Drawing Sheets

(51) Int. Cl.

| | |
|---|---|
| ***E04D 3/30*** | (2006.01) |
| ***E04B 5/40*** | (2006.01) |
| ***E04C 2/08*** | (2006.01) |
| ***E04D 3/362*** | (2006.01) |

(52) U.S. Cl.

CPC ..... *E04D 3/30* (2013.01); *E04D 3/362* (2013.01); *E04D 3/365* (2013.01)

(56) References Cited

U.S. PATENT DOCUMENTS

| | | | | |
|---|---|---|---|---|
| 326,557 | A | 9/1885 | Hayes | |
| 345,687 | A | 7/1886 | Hayes | |
| 426,627 | A | 4/1890 | Sagendorph | |
| 824,551 | A | 6/1906 | Levis | |
| 938,869 | A | 11/1909 | Hunter | |
| 968,887 | A | 8/1910 | Roth | |
| 993,686 | A | 5/1911 | Howard | |
| 1,292,960 | A | 1/1919 | Owens | |
| 1,743,209 | A | 1/1930 | Groehn | |
| 2,254,558 | A | 9/1941 | Williams | |
| 2,602,408 | A | 7/1952 | Smith-Johannsen | |
| 2,619,855 | A | 12/1952 | Williams | |
| 2,626,687 | A | 1/1953 | Williams | |
| 2,668,890 | A | 2/1954 | Latour | |
| 2,829,714 | A | 4/1958 | Kalb | |
| 2,874,666 | A | 2/1959 | Thor | |
| 2,924,312 | A | 2/1960 | Williams | |
| 2,964,829 | A | 12/1960 | Spengler et al. | |
| 3,010,199 | A | 11/1961 | Smith et al. | |
| 3,110,079 | A | 11/1963 | Wilson et al. | |
| 3,163,931 | A | 1/1965 | Nielsen | |
| 3,213,583 | A | 10/1965 | Winski | |
| 3,312,028 | A | 4/1967 | Schroyer | |
| 3,399,503 | A | 9/1968 | Payne et al. | |
| 3,411,339 | A | 11/1968 | Brown | |
| 3,465,414 | A | 9/1969 | Koett | |
| 3,474,585 | A | 10/1969 | Foster | |
| 3,511,011 | A * | 5/1970 | Straus | E04D 3/30 52/478 |
| 3,535,843 | A | 10/1970 | Hughes | |
| 3,606,718 | A * | 9/1971 | Straus | E04C 2/322 52/542 |
| 3,624,876 | A | 12/1971 | Irvin | |
| 3,641,729 | A | 2/1972 | Irvin | |
| 3,714,688 | A | 2/1973 | Olson | |
| 3,726,000 | A | 4/1973 | Hafner | |
| 3,728,779 | A | 4/1973 | Behlen et al. | |
| 3,877,280 | A | 4/1975 | Cornell | |
| 3,889,437 | A | 6/1975 | Day et al. | |
| 3,924,378 | A | 12/1975 | Hafner | |
| 3,982,373 | A | 9/1976 | Wilson et al. | |
| 4,035,901 | A | 7/1977 | Lux et al. | |
| D256,843 | S | 9/1980 | Madsen | |
| 4,224,775 | A | 9/1980 | Heckelsberg | |
| 4,233,795 | A | 11/1980 | Snyder et al. | |
| 4,353,240 | A | 10/1982 | Undin et al. | |
| 4,392,295 | A | 7/1983 | Sasai et al. | |
| 4,442,581 | A | 4/1984 | Molnick | |
| 4,459,735 | A | 7/1984 | Sawdon | |
| 4,525,976 | A | 7/1985 | Simpson | |
| 4,531,397 | A | 7/1985 | Pratt | |
| 4,558,584 | A | 12/1985 | Myers | |
| 4,571,975 | A | 2/1986 | Pawloski et al. | |
| 4,575,983 | A | 3/1986 | Lott, Jr. et al. | |
| 4,759,165 | A | 7/1988 | Getoor et al. | |
| 4,860,514 | A | 8/1989 | Kelly | |
| 4,893,493 | A | 1/1990 | Jacques et al. | |
| 4,986,691 | A | 1/1991 | Hafner | |
| 4,987,716 | A * | 1/1991 | Boyd | E04D 15/04 52/520 |
| 4,989,438 | A | 2/1991 | Simon | |
| RE33,563 | E | 4/1991 | Heckelsberg | |
| RE33,566 | E | 4/1991 | Heckelsberg | |
| 5,187,911 | A | 2/1993 | Cotter | |
| 5,221,183 | A | 6/1993 | Hoeffken | |
| 5,247,772 | A | 9/1993 | Greenberg | |
| 5,337,535 | A | 8/1994 | Maupin | |
| 5,381,686 | A | 1/1995 | Thorup | |
| 5,509,291 | A | 4/1996 | Nilsson et al. | |
| 5,524,409 | A * | 6/1996 | Kaiser | E04D 3/362 52/537 |
| 5,600,971 | A | 2/1997 | Suk | |
| 5,651,221 | A * | 7/1997 | Golen | E06B 9/02 49/464 |
| 5,697,197 | A | 12/1997 | Simpson | |
| 5,715,639 | A | 2/1998 | Yamada | |
| 5,860,265 | A | 1/1999 | Knudson et al. | |
| 5,878,617 | A | 3/1999 | Parker | |
| 5,884,405 | A | 3/1999 | Breeden | |
| 5,976,292 | A | 11/1999 | Barksdale et al. | |
| 6,070,449 | A | 6/2000 | Vachon | |
| 6,076,320 | A | 6/2000 | Butler | |
| 6,212,932 | B1 | 4/2001 | Parker | |
| 6,250,036 | B1 | 6/2001 | Nurley et al. | |
| 6,397,469 | B2 | 6/2002 | Parker | |
| 6,527,335 | B1 | 3/2003 | Yurgevich | |
| 6,689,449 | B2 | 2/2004 | Hasan et al. | |
| 6,904,730 | B2 | 6/2005 | Mitchell | |
| 7,021,023 | B2 | 4/2006 | Rood, Jr. | |
| 7,104,020 | B1 | 9/2006 | Suttle | |
| 7,162,788 | B2 | 1/2007 | Inch et al. | |
| 7,353,584 | B2 | 4/2008 | DeFreese et al. | |
| 7,434,314 | B2 | 10/2008 | Morton | |
| 7,634,882 | B1 | 12/2009 | Briggs et al. | |
| 7,874,117 | B1 * | 1/2011 | Simpson | E04D 3/362 52/520 |
| 7,891,308 | B2 | 2/2011 | Bianchi et al. | |
| 7,963,083 | B1 | 6/2011 | Briggs et al. | |
| 7,984,596 | B1 | 7/2011 | Simpson et al. | |
| 8,141,221 | B2 | 3/2012 | Webb et al. | |
| 8,146,314 | B2 * | 4/2012 | Nguyen | E04B 1/08 52/241 |
| 8,171,689 | B2 | 5/2012 | Pierson et al. | |
| 8,322,014 | B1 | 12/2012 | Rider | |
| 2013/0074434 | A1 | 3/2013 | Wiens | |
| 2015/0308116 | A1 * | 10/2015 | Bogh | E04C 2/322 52/579 |
| 2015/0322686 | A1 | 11/2015 | Harper et al. | |
| 2016/0333584 | A1 * | 11/2016 | Bogh | E04D 3/365 |

FOREIGN PATENT DOCUMENTS

| | | | |
|---|---|---|---|
| DE | 2423226 | A1 | 11/1975 |
| GB | 2397074 | A | 7/2004 |
| JP | 57165550 | A | 10/1982 |
| KR | 200476203 | Y1 | 2/2015 |
| WO | 2004106661 | A1 | 12/2004 |
| WO | 2006125248 | A1 | 11/2006 |

* cited by examiner

STRUCTURAL PANEL SYSTEMS WITH A NESTED SIDELAP AND METHOD OF SECURING

CLAIM OF PRIORITY UNDER 35 U.S.C. §119

The present application for a patent claims priority to U.S. Provisional Patent Application Ser. No. 62/161,710 entitled "Structural Panel Sytems with a Nested Seam and Method of Securing" filed on May 14, 2015 and assigned to the assignees hereof and hereby expressly incorporated by reference herein.

FIELD

This application relates generally to the field of structural panel systems and more particularly to improvements to structural panel systems due to an improved sidelap created between adjacent structural panels.

BACKGROUND

Structural panels are used in commercial or industrial construction (and in some cases residential construction), for example, as a component of poured concrete floors or as structural roofing (e.g., for commercial buildings, industrial buildings, institutional buildings, or the like). Structural panels may be typically manufactured from steel sheets, which may or may not be coiled. In order to increase the structural strength and the stiffness of the individual steel sheets, structural panels with longitudinal profiles are formed from the steel sheets via roll forming, break forming, bending, stamping, or other like processes. The structural panels are secured to each other in order to form the structural steel panel system when installed. These structural panels may be used as roof decking, floor decking, or wall panels. As such, corrugated structural panels may be used in a variety of building applications.

The panels are also connected to the other load resisting structural members of a building, such as steel beams, joists, walls, other structural elements, or the like. When the panels are connected to each other in a secure manner for roof or floor applications, the assembled structural steel decking system provides considerable diaphragm (or membrane) strength, which is used to transfer horizontal loads to the vertical and lateral load carrying components of the building. When the structural panels are used in wall systems, the structural wall panels are used to transfer vertical and lateral loads to the horizontal load carrying components.

In geographic regions that are prone to seismic activity (e.g., earthquakes) and/or high winds, the structural panels are solidly connected to each other and to the other load resisting structural members of the building so that the building is better able to withstand shear forces (e.g., horizontal shear forces and vertical shear forces) created by the seismic activity and/or high winds. The structural panels are connected to reduce, or eliminate excessive, out-of-plane separation (e.g., vertical separation between the sheets in the case of structural decking panels, or horizontal separation between the sheets in the case of structural wall panels; stated otherwise as out-of-plane movement in which the edges of the sheets move apart from each other) or in-plane movement (e.g., horizontal movement between the sheets in the case of structural decking panels or vertical movement between the sheets in the case of structural wall panels; stated otherwise as in-plane movement in which the sheets slip along the length of the edges). To this end, the sidelap between adjacent structural panels is joined in such a way as to create resistance in a direction parallel to the lengthwise extending axis of the sidelap to thereby carry loads (e.g., resist forces) and prevent displacement between the structural panels. In addition, the connection of the panels at the sidelap also creates resistance in a direction perpendicular to the lengthwise extending axis of the sidelap in order to carry loads (e.g., construction loads) and to maintain the structural integrity of the diaphragm strength of the system.

BRIEF SUMMARY

Structural steel panels (e.g., structural decking panels or structural wall panels) may be provided with two edges: one edge having an "upper lip" otherwise described as a "top lip" or "outer lip" (e.g., collectively described as a lip that is exposed when viewed from the side of the structural panels being installed, such as the top of the decking), and an opposite edge having a "lower lip" otherwise described as a "bottom lip" or "inner lip" (e.g., collectively described as a lip that is located at least partially under or behind the upper lip and is exposed on the opposite side of the structural panels being installed, such as from the bottom of the decking). In some embodiments the lower lip is a nested lip, such that the upper lip, and in some embodiments at least a portion of the panel profile, is nested within the lower lip. In some embodiments, the upper lip and the lower lip may both be a double layer of the material thickness of the structural panels associated with the lips, such that each lip is a two layer lip formed from an edge of material folded back upon itself to create an edge that has two layers. When the upper lip is placed over the lower lip the sidelap formed may comprise four layers. In other embodiments of the invention the upper lip or the lower lip, or a portion thereof, may comprise only a single layer, such that when the upper lip is positioned over the lower lip a three layer sidelap is formed. In other embodiments of the invention the sidelap formed from the upper lip and lower lip may have more than four layers.

A single structural panel may have one edge with an upper lip and a second opposite edge with a lower lip. In other embodiments of the invention one panel may have two upper lips and adjacent panels may have two lower lips. Individual panels may be coupled together by placing the upper lip of a first panel over the lower lip of an adjacent panel, thus creating an un-joined horizontal sidelap along the length of the panel edges having either four or more layers of a thickness of the adjacent structural panels (or in some embodiments three or more layers). As such, in some embodiments of the invention, the lower lip has two layers and the upper lip also has two layers. In other embodiments of the invention other types of sidelaps having different configurations of the layers or three or more layers may be utilized in the present invention, which are described in further detail below.

In order to couple (e.g., secure, join, or the like) the panels together along the sidelap to prevent or reduce the movement of one panel moving out-of-plane (e.g., vertical lifting separation in the case of structural decking panels, or horizontal separation in the case of structural wall panels) or in-plane movement with respect to each other (e.g., lateral movement in the case of structural decking panels, or vertical movement in the case of structural wall panels), the panels may be secured through various coupling configurations. The couplings described herein may also be described generally as joints, connections, attachments, or the like. One example of a coupling in the present invention may be a fastener (e.g., screw, pin, rivet, bolt, or the like) that is located within an aperture within the sidelap (e.g., an aperture created before the fastener is installed or by the fastener as it is being installed). In one embodiment the fastener may be able to penetrate through three, four, five, or more layers of a sidelap (depending on the number of layers in the sidelap), such as through the use of self-drilling screws, screws that can punch or puncture, rivets that can punch or puncture, or the like through the layers of the sidelap. In other embodiments of the invention an aperture may be pre-drilled before the fastener is located (e.g., drilled or inserted) into the pre-drilled hole. In other embodiments of the invention the sidelaps having three or more layers may be welded together to form the coupling. The weld may occur in the middle of the sidelap, along one or more of the edges of the sidelap, or both. Alternatively, the couplings may be formed by deforming at least a portion of the upper lip over or through at least a portion of the lower lip (or vice versa). The coupling may also be formed by cutting, forming, and/or displacing a portion of the sidelap, such as punching a hole through the sidelap, shearing the sidelap, or the like to create the coupling. One or more of these may be used to form the coupling, for example, deforming or displacing the sidelap and cutting and/or forming a portion of the sidelap may both occur in order to create the coupling. In one example, shearing and deforming of a portion of the sidelap may create a louver that results in a tab that provides interference at the ends of the tab to resist lateral movement of the adjacent panels. In still other embodiments of the invention, the couplings may be formed through other like fastening means.

The couplings formed in the sidelap may be located at predetermined optimal intervals along the length of the sidelap to join the structural panels and prevent or reduce movement between them. Not only do the couplings help prevent or reduce out-of-plane separation between adjacent panels, but the couplings prevent or minimize in-plane shifting along the sidelap and ensure a desired level of shear strength and flexibility in the sidelap and across the structural panel system.

The four layer sidelap, illustrated in some embodiments of the present invention, results in improved shear strength along the length of the sidelap. As such, because of the improved shear strength in the four layer sidelap (or other sidelap with three or more layers), thinner material thicknesses may be used for the structural panels and/or not as many couplings are needed to create a structural panel system that has a shear strength that is the same as or similar to the shear strength of a structural panel system that utilizes a two layer nested sidelap, an interlocking in-plane sidelap, an out-of-plane three layer interlocking sidelap, or other like sidelap configuration. As such, using structural panel systems with four layer sidelaps (or sidelaps having three or more layers in some embodiments), results in structural panel systems that cost less due to reduced material costs (e.g., reduced price for thinner steel structural panels) and/or due to reduced assembly costs (e.g., assembly time is reduced due to fewer coupling locations). It should be understood that the sidelap, as described herein, is the location where adjacent panels meet each other. As described herein the sidelap may be an overlapping in-plane sidelap with three or more layers (e.g., nested or not nested). Other types of sidelaps may include interlocking in-plane sidelaps, standing or out-of-plane interlocking sidelaps, or other like types of sidelaps.

Embodiments of the invention include structural panel systems and methods of forming structural panel system. One embodiment includes a structural panel system comprising a first structural panel comprising first top flanges, first bottom flanges, and at least one edge comprising an upper lip, and a second structural panel comprising second top flanges, second bottom flanges, and at least one edge comprising a lower lip. The upper lip of the first structural panel is placed over the lower lip of the second structural panel to create a sidelap with three or more layers, wherein the sidelap is generally in-plane with respect to the first structural panel and the second structural panel. The structural panel system further includes one or more couplings formed in the sidelap with three or more layers to couple the first structural panel to the second structural panel.

In further accord with embodiments of the invention, the lower lip comprises a first lower layer and a second lower layer, and the second lower layer is folded back upon the first lower layer to form a lower lip with two layers in an in-plane orientation with respect to the second structural panel.

In other embodiments of the invention, the second lower layer is folded on top of the first lower layer or folded under the first lower layer.

In still other embodiments of the invention, the lower lip comprises a nested portion curved upwardly from an in-plane orientation of the lower lip with respect to the second structural panel, and a lower flange corner of the first structural panel rests within the nested portion of the lower lip.

In yet other embodiments of the invention, the upper lip comprises a first upper layer and a second upper layer. The second upper layer is folded back upon the first upper layer to form an upper lip with two layers in an in-plane orientation with respect to the first structural panel.

In further accord with embodiments of the invention, the second upper layer is folded on top of the first upper layer or folded under the first upper layer.

In other embodiments of the invention, the sidelap formed from the upper lip placed over the lower lip forms a sidelap with four or more layers.

In still other embodiments of the invention, the one or more couplings are fasteners that operatively couple the upper lip to the lower lip.

In yet other embodiments of the invention, the one or more couplings are formed by welding the upper lip to the lower lip, or by cutting the upper lip and lower lip to operatively couple the upper lip to the lower lip.

In further accord with embodiments of the invention, the upper lip is formed at least partially along a web and is bent at a lower flange corner in an in-plane orientation with respect to the first structural panel to form an in-plane edge of the first structural panel, and wherein the lower lip is formed at least partially along an edge of the second structural panel in an in-plane orientation with respect to the second structural panel and is bent upwardly in order to receive the upper lip formed along the web, the lower flange corner, and the in-plane edge of the first structural panel.

In other embodiments of the invention, the one or more couplings in the sidelap with the three or more layers improves the shear strength of the sidelap by greater than a factor of 1.05 over a sidelap with two layers.

In still other embodiments of the invention, the one or more couplings in the sidelap with the three or more layers results in a shear strength that is the same as or similar to a sidelap with two layers with at least 5 percent fewer couplings in the sidelap with the three or more layers.

In yet other embodiments of the invention, the one or more couplings in the sidelap with the three or more layers results in a shear strength that is the same as or similar to a two layer sidelap with a material thickness of the first or second structural panels that is at least 5 percent thinner than the two layer sidelap structural panel thickness.

In further accord with embodiments of the invention, the first panel and the second panel of the structural panel system has a first material thickness, a first number of couplings from the one or more couplings, and a first shear strength that is the same or similar to a second shear strength of a second structural panel system utilizing a two layer sidelap having a second material thickness greater than the first material thickness and a second number of couplings greater than the first number of couplings when a length and a width of the structural panel system is the same as the second structural panel system.

Another embodiment of the invention is a structural panel system for a building structure that comprises two or more support members, a first structural panel comprising first top flanges, first bottom flanges, and at least one edge comprising an upper lip, wherein the first structural panel is operatively coupled to at least one of the two or more support members, and a second structural panel comprising second top flanges, second bottom flanges, and at least one edge comprising a lower lip, wherein the second structural panel is operatively coupled to at least one of the two or more support members. The upper lip of the second structural panel is placed over the lower lip of the first structural panel to create a sidelap with four or more layers, and the sidelap is generally in-plane with respect to the first structural panel and second structural panel. The system further includes one or more couplings formed in the sidelap to couple the first structural panel to the second structural panel.

In further accord with embodiments of the invention, the lower lip comprises a first lower layer, a second lower layer, and the second lower layer is folded on top of or under the first lower layer to form a lower lip with two layers. The upper lip comprises a first upper layer, a second upper layer, and the second upper layer is folded on top of or under the first lower layer to form an upper lip with two layers.

In other embodiments of the invention, the lower lip comprises a nested portion curved upwardly from the in-plane orientation of the lower lip, and a lower flange corner of the first structural panel rests within the nested portion of the lower lip.

In still other embodiments of the invention, the first structural panel and the second structural panel of the structural panel system has a first material thickness, a first number of couplings from the one or more couplings, and a first shear strength that is the same or similar to a second shear strength of a second structural panel system utilizing a two layer in-plane sidelap having a second material thickness greater than the first material thickness and/or a second number of couplings greater than the first number of couplings, and wherein a length and a width of the structural panel system is the same as the second structural panel system.

Another embodiment of the invention is a method of assembling a structural panel system. The method comprises assembling a first structural panel to at least one of two or more support members, wherein the first structural panel comprises first top flanges, first bottom flanges, and at least one edge comprising an upper lip. The method further comprises assembling a second structural panel to at least one of the two or more support members, wherein the second structural panel comprises second top flanges, second bottom flanges, and at least one edge comprising a lower lip. The method also includes assembling the upper lip of the second structural panel over the lower lip of the first structural panel to create a sidelap with four or more layers that is in a generally in-plane orientation with respect to the first structural panel and the second structural panel. The method also includes forming one or more couplings in the sidelap to couple the first structural panel to the second structural panel.

In further accord with embodiments of the invention, the lower lip further comprises a nested portion curved upwardly from the in-plane orientation of the lower lip, and assembling the upper lip over the lower lip further comprises nesting a lower flange corner of the first structural panel within the nested portion of the lower lip.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Figure 1:
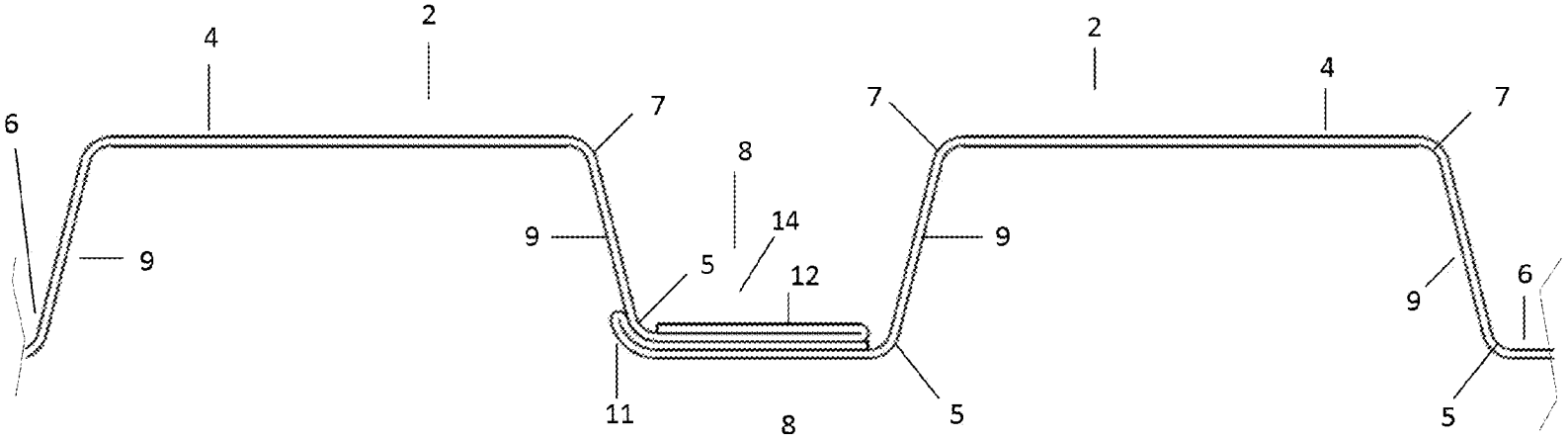
FIG. 1 illustrates a profile view of a portion of a structural panel system having a sidelap with a two layer upper lip placed over a two layer lower lip, in accordance with embodiments of the present invention.

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

The present invention relates to methods for manufacturing and assembling structural panels, as well as the structural panel systems formed from the methods. The present invention relates to panels with various types of generally in-plane sidelaps (e.g., three layer, four layer, more, or the like), sidelaps at an angle, or sidelaps around a bend in a lower flange corner of the structural panel, or the like. The sidelaps have an upper lip on an edge of a first panel and a lower lip on an edge of an adjacent second panel. The sidelaps formed from the lower lip and the upper lip include a total of at least four layers (or three layers in other embodiments of the invention) when the upper lip is placed over the lower lip. In other embodiments, there may be additional layers in the sidelap, such as five layers, six layers, or the like. A four layer sidelap may provide the desired results (e.g., prevent or reduce out-of-plane separation, prevent or minimize in-plane shifting along the sidelap, and ensure a desired level of shear strength across the structural panel systems) when couplings (e.g., fasteners, welds, sheared sections, or the like) are formed in the sidelap, which allows for a reduced number of coupling joint locations and/or a reduced thickness of the structural panels.

In some embodiments of the invention, fasteners are used to creating the couplings in the sidelap of four or more layers to operatively couple the panels together. In other embodiments the four or more layers of the sidelap are welded through the top surface of the upper layer, or through an edge surface of the upper lip and/or lower lip, in order to operatively couple the panels together. In some of the couplings the weld may not engage all of the four or more layers of the sidelap. In other embodiments, the four or more layers of the sidelap are cut (e.g., sheared through, punched through, or the like) in multiple locations along the sidelap in order to couple the first panel to the second panel. The locations of the couplings in the sidelap may be placed at specific intervals or interval ranges in order to provide the desired shear strength and/or stiffness (e.g., flexibility) along the length of the sidelap of the assembled structural panel system. The distances at which the couplings are formed in the sidelap will be discussed in further detail later.

The structural panels 2 used to form the structural system may be manufactured from a variety of rigid materials including steel, aluminum, titanium, plastic, a composite, or another type of rigid material. Typical structural panels 2 are made of steel and are sized in ranges from 12 inches to 42 inches wide by 1 foot to 50 feet long. These dimensions include some sizes of structural panels 2, but it should be understood that any size of structural panels 2 within these ranges, overlapping these ranges, or outside of these ranges might be utilized with the present invention. The material thickness of the structural panels 2 may be any thickness; however, typical panel thicknesses may have the thicknesses of 29 gage panels to 16 gage panels, inclusive (or up to 14 gage, inclusive). Other material thicknesses of the present invention may be within this range, overlap this range, or be located outside of this range.

As illustrated throughout the figures, the structural panels 2 may have profiles that include top flanges 4 (otherwise described as peaks, upper flanges, outer flanges, or the like), bottom flanges 6 (otherwise described as troughs, lower flanges, inner flanges, or the like), and webs 9 (e.g., the portions of the panel that are sloped, perpendicular, or generally perpendicular with the flanges 4, 6) that operatively couple the top flanges 4 to the bottom flanges 6, all of which will be generally discussed in further detail below.

The combination of top and bottom flanges 4, 6, and the webs 9 create a flute for the structural panels 2. The profiles may be referred to as "fluted profiles," "hat profiles", "flat-bottomed profiles", "triangular profiles," "trapezoidal profiles," "dovetail profiles," or other like profiles. The distance from the top of the top flange 4 and the bottom of the bottom flange 4 may generally range from a ½ inch to 3 inches in depth; however, other ranges of depths within this range, overlapping this range, or outside of this range may be used in the profiles. For example, in some embodiments the distance may range from ½ inch to 12 inches in depth, or the like (e.g., for the profiles illustrated in FIGS. 14F and 14G, as well as the other profiles whether or not they are specifically illustrated herein). The panels 2 may or may not include longitudinal ribs, bends, or cutouts that impact the moment of inertia and section modulus of the panels 2 (e.g., profile dimensions, ribs, cutouts, or the like are used to target different performance characteristics, such as but not limited to strength and/or stiffness). Depending on the material thickness, the length and width of the panels 2, and the height of the top flanges 4 and bottom flanges 6, the panels 2 may weigh between 100 and 420 lbs. In other embodiments, the weight of the panels may be within, overlap, or be located outside of this range.

The sizes and thicknesses of the structural panels 2 are determined based on the engineering requirements for the desired application of the structural panel systems. In one particular embodiment of the invention, the structural panels 2 are used as roofs and/or walls within a building, and are required to meet the structural requirements for withstanding potential seismic activity, high winds, and/or other natural or man-made forces. As discussed in further detail below, if the couplings are not properly spaced along the sidelap or are not formed properly within the sidelap, the weakest location of the roof and/or walls may be along the sidelap of the roof and/walls. As described herein, the present invention provides improved sidelaps and couplings of the structural panels 2, which allows for increased shear strengths and/or stiffness at the sidelaps, and thus allows for a reduced thickness of the structural panels 2 and/or couplings that are spaced farther apart from one another without decreasing the shear strength of the overall system. As such, the reduced thickness of the structural panels 2 reduces the material costs and/or the reduced number of couplings reduces the labor costs associated with the structural systems of the present invention, when compared with other structural systems that have the same or similar shear strength.

Each structural panel 2 may be formed (e.g., roll-formed, or the like) into the desired profile. Typically, the structural panel 2 profile includes top flanges 4, bottom flanges 6, and webs 9 that form different shapes and sizes which create the various types of profiles (e.g., hat profiles, vee profiles, triangular profiles, dovetail profiles, or any other type of structural panel profile) described in further detail later.

Panel edges 8 (e.g., the opposite longer sides of the structural panel 2) may be formed into lips that couple a first structural panel 2 to an adjacent second structural panel 2. The lips on opposite edges 8 of a structural panel 2 may include a "lower lip" 10 and an "upper lip" 12, which may be nested with the opposing lips on adjacent structural panels 2. For example, adjacent structural panels 2 may be coupled together by resting the upper lip 12 of a first structural panel edge 8 on top of the lower lip 10 of a second structural panel edge 8. The lower lip 10 may be dimensioned in some embodiments in order to allow the upper lip 12 to fit within a nested portion 11 of the lower lip 10 over at least a portion of the length of, or the entire length of, the edge of the structural panel edges 8 without the use of tools in order to form an un-joined sidelap 14. As will be explained in further detail, couplings (also described as joints, connections, attachments, or the like) may be formed in the sidelap 14 of the structural panels 2 to couple adjacent structural panels 2 to each other. Multiple structural panels 2 may be modularly configured to create a variety of differently sized walls, floors, or roofing arrangements (e.g., different parts of the wall, floor, or roof may have different panels 2 with different material thicknesses and/or other dimensions). In other embodiments of the invention, a first structural panel 2 may have two lower lips 10 on each edge 8 and a second structural panel 2 may have two upper lips 12 on each edge 8, such that the structural panels are alternated when assembled to form the structural system.

One structural panel edge 8 may include a generally in-plane lower lip 10 (e.g., located between 45 degrees +/− from a parallel orientation with the plane of the structural panel, or the like) as illustrated in FIGS. 1-8. The lower lip 10 may be offset from one of the structural top flanges 4, such that the lower lip 10 does not extend around a lower flange corner 5 and/or web 9. In one embodiment the lower lip 10 may comprise a nested portion 11 at the end of the lower lip 10, which has a radius of curvature and is curved upwardly from an in-plane orientation with respect to the structural panel 2. The nested portion 11 of the lower lip 10 may have the same shape as a lower flange corner 5 of an edge 8 of an adjacent structural panel 2. As such the nested portion 11 of a lower lip 10 of a second structural panel 2 may allow the flanged corner 5 of a first structural panel 2 to lie within the nested portion 11 when the upper lip 12 is placed over the lower lip 10.

Figure 2:
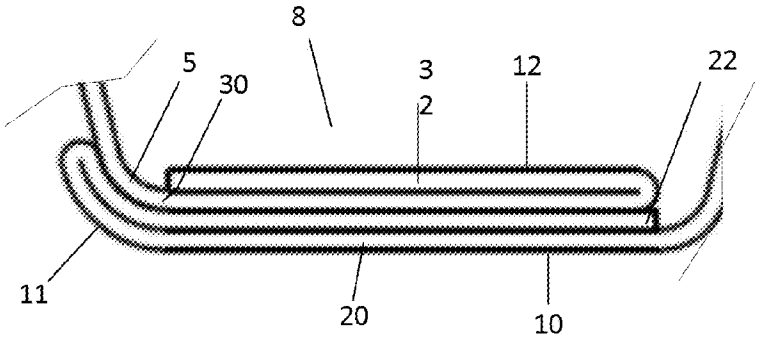
FIG. 2 illustrates an enlarged view of the profile of the sidelap of the structural panel system illustrated in FIG. 1, in accordance with embodiments of the present invention.

The lower lip 10 may be created at one of the structural panel edges 8 by roll forming (or other like operation) the structural panel edge 8 into a generally flat horizontal shape (as illustrated in FIGS. 1-8), or another shape such as a bowed shaped (e.g., concave or convex), or the like. The lower lip 10 may have a first lower lip layer 20 that is extended in a generally in-plane orientation, as illustrated in FIG. 2. As further illustrated in FIG. 2, the lower lip 10 may have a second lower lip layer 22 that is folded inwardly back towards the upper surface (e.g., top surface or outer surface, such as the surface that faces up when decking is installed) of the structural panel edge 8, as depicted in FIG. 2, such that the first lower lip layer 20 is the bottom layer of the lower lip 10 and the second lower lip layer 22 is the top layer of the lower lip 10. In other embodiments, not illustrated in the Figures, the second lower lip layer 22 may be folded outwardly back towards the lower surface (e.g., bottom surface or inner surface, such as the surface that faces down when the deck is installed) of the structural panel edge 8, such that the first lower lip layer 20 is the top layer of the lower lip 10 and the second lower lip layer is the bottom layer of the lower lip 10.

The figures illustrate that the first lower lip layer 20 and the second lower lip layer 22 touch; however, it should be understood that in some embodiments there may be no gap between the surfaces of the first lower lip layer 20 and the second lower lip layer 22 (as illustrated in the figures), may be some gaps along at least a portion of the first lower lip layer 20 and the second lower lip layer 22, or a gap along the entire length of the lower lip 10 between the first lower lip layer 20 and the second lower lip layer 22. As such, in some embodiments of the invention the second lower lip layer 22 may converge towards the first lower lip layer 20, diverge away from the first lower lip layer 20, or both depending on the location along the length of the lower lip 10.

When folded, the lower lip 10 typically includes a thickness of two layers of the structural panel 2 as illustrated in FIGS. 1-6. By including two structural panel layers in the lower lip 10, the strength of the lower lip 10 with two layers is improved over the strength of a lower lip 10 with a single lower lip layer along the structural panel edge 8. As such, the lower lip 10 with two layers is less likely to be bent out of position before installation, and has improved strength even before the upper lip 12 of an adjacent structural panel 2 is placed over the lower lip 10 and the couplings are created. Moreover, after the couplings are formed the shear strength of the sidelap 14 formed by coupling the two layer lower lip 10 to the two layer upper lip 12 increases the shear strength of the sidelap, thus allowing for the use of a reduced number of couplings and/or reduced material thickness of the structural panels 2 (e.g., as determined before the structural panels are installed). As such, utilization of the two layer lower lip 10 and two layer upper lip 12 may enable the use of structural panels 2 with reduced material thicknesses (e.g., higher gage panels) to achieve the same or similar shear strengths along the sidelap as other structural panels with greater material thicknesses (e.g., lower gage panels) that utilize a single layer for the lips (e.g., a two layer overlapping sidelap) or utilize a standing out-of-plane interlocking sidelap configuration, as explained in further detail later.

The opposite structural panel edge 8 may include a generally in-plane upper lip 12 (e.g., located between 45 degrees +/− from a parallel orientation with the plane of the structural panel 2, or the like) as illustrated in FIGS. 1-8. The upper lip 12 may be offset from one of the top flanges 4, such that the upper lip 12 does not extend around a lower flange corner 5 and/or web 9. In one embodiment the upper lip 12 may comprise a nested portion at the end of the upper lip 12, which has a radius of curvature and is curved upwardly from an in-plane orientation with respect to the structural panel 2 (not illustrated in the Figures). The nested portion of the upper lip 12 may have the same shape as a lower flange corner 5 of an edge 8 of an adjacent structural panel 2. As such, the nested portion of an upper lip 12 of a first structural panel 2 may lie within the flanged corner 5 and/or over the web 9 of a second structural panel 2 when the upper lip 12 is placed over the lower lip 10. As such, in some embodiments the edges 8 of all the structural panels 2 may have the same lip (e.g., the lower lip 10 is the same as the upper lip 12), such that the structural panel may be utilized in either a right-handed or left handed configuration and are interchangeable with each other, which may reduce assembly or installation costs.

Figure 4:
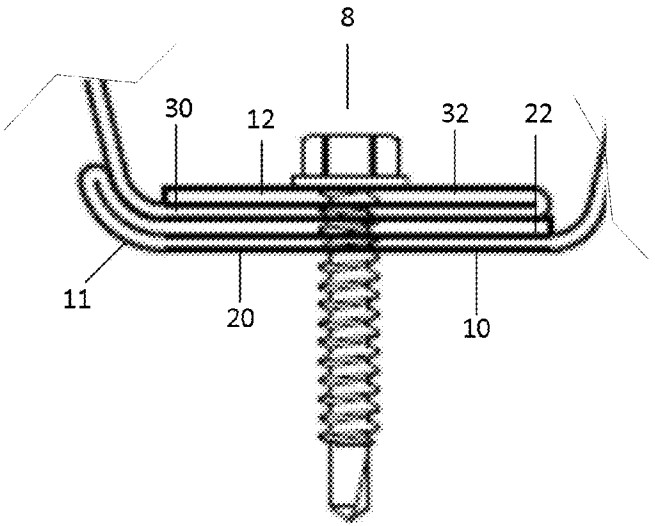
FIG. 4 illustrates an enlarged view of the profile of the sidelap and fastener coupling of FIG. 3, in accordance with embodiments of the present invention.

The upper lip 12 may be created at one of the structural panel edges 8 by roll forming (or other like operation) the structural panel edge 8 into a generally flat in-plane shape (e.g., horizontal orientation in roof or floor systems) as illustrated in the Figures, or another shape such as a bowed shaped (e.g., concave or convex), or the like. The upper lip 12 may have a first upper lip layer 30 that is extended in a generally in-plane orientation, as illustrated in FIG. 4. As further illustrated in FIG. 4, the upper lip 12 may have a second upper lip layer 32 that is folded inwardly back towards the upper surface (e.g., top surface or outer surface, such as the surface that faces up when the decking is installed) of the structural panel edge 8, as depicted in FIG. 2, such that the first upper lip layer 30 is the bottom layer of the upper lip 12 and the second upper lip layer 32 is the top layer of the upper lip 12. In other embodiments, not illustrated in the Figures, the second upper lip layer 32 may be folded outwardly back towards the lower surface (e.g., bottom surface or inner surface, such as the surface that faces down when the decking is installed) of the structural panel edge 8, such that the first upper lip layer 30 is the top layer of the upper lip 12 and the second upper lip layer 32 is the bottom layer of the upper lip 12.

The figures illustrate that the first upper lip layer 30 and the second upper lip layer 32 touch. However it should be understood that in some embodiments there may be no gap between the surfaces of the first upper lip layer 30 and the second upper lip layer 32 (as illustrated in the figures), may be some gaps along at least a portion of the first upper lip layer 30 and the second upper lip layer 32, or a gap along the entire length of the upper lip 12 between the first upper lip layer 30 and the second upper lip layer 32. As such, in some embodiments of the invention the second upper lip layer 32 may converge towards the first upper lip layer 32, diverge away from the first upper lip layer 32, or both depending on the location along the length of the lower lip 10.

When folded, the upper lip 12 typically includes a thickness of two layers of the structural panel 2 as illustrated in FIGS. 1-4, 7, and 8. By including two structural panel layers in the upper lip 12, the strength of the upper lip 12 with two layers is improved over the strength of an upper lip 12 with a single upper lip layer along the structural panel edge 8. As such, the upper lip 12 with two layers is less likely to be bent out of position before installation, and has improved strength even before the upper lip 12 is placed over a lower lip 10 of an adjacent structural panel 2 and the couplings are created. Moreover, after the couplings are formed the shear strength of the sidelap 14 formed by coupling the two layer upper lip 12 to the two layer lower lip 10 increases the shear strength of the sidelap, thus allowing for the use of a reduced number of couplings and/or reduced material thickness of the structural panels 2 (e.g., as determined before the structural panels are installed). As such, utilization of the two layer lower lip 10 and two layer upper lip 12 may enable the use of structural panels 2 with reduced material thicknesses (e.g., higher gage panels) to achieve the same or similar shear strengths along the sidelap as other structural panels with greater material thicknesses (e.g., lower gage panels) that utilize a single layer for the lips (e.g., a two layer nested sidelap) or a standing sidelap, as discussed later in further detail.

It should be understood that the layers of the upper lip 12 and lower lip 14 may have generally straight sections (e.g., parallel sections without bends with the exception of the nested portions that may have a curvature at the ends of one or more of the lip) through which the couplings are made. These straight sections provide for ideal locations to form at least some of the couplings, such as the fasteners.

The width of the sidelap 14 illustrated in the various embodiments of the Figures, may extend over at least 80% of the bottom flange 6 created between two adjacent top flanges 4 of adjacent structural panels 2. In some embodiments the width of the sidelap 14 may range from 25% to 100% (or 50% to 100%, or the like) of the bottom flange 6 created between two adjacent top flanges 4 of adjacent structural panels 2. In other embodiments, the range of the widths described above may be within the stated percentage range, fall outside of the stated percentage range, or overlap the stated percentage range. In some embodiments the upper lip 12 and/or the lower lip 10 may extend beyond the lower flange corners 5 of the adjacent structural panels 2. In still other embodiments the sidelap 4 with three or more layer may be located over a width within the center, on the left side, on the right side, or anywhere else within the bottom flange 6 created between two adjacent top flanges 4 of adjacent structural panels 2.

In order to couple two adjacent panels 2 together, the lower lip 10 of a first structural panel 2 (with or without the nested portion 11) may receive an upper lip 12 of a second structural panel 2. The upper lip 12 may be placed over the lower lip 10 as depicted in FIG. 2 to create an un-joined sidelap 14 (e.g., a generally in-plane sidelap) along the length of adjacent structural panel edges 14. The purpose of the sidelap 14 formed after coupling (e.g., utilizing a fastener, deforming or displacing, cutting, and/or forming, welding, or the like) is to couple two adjacent structural panels 2 securely to each other in order to prevent one panel from separating transversely from another panel (e.g., lifting vertically off another panel in a horizontal roof installation or lifting horizontally away from another panel in a vertical wall installation), preventing in-plane movement (e.g., shifting of the panels along the sidelap) between the adjacent structural panels 2, and providing the desired shear strength of the structural system, such that the structural system, including the sidelap 14, meets the structural requirements for the application. When the lower lip 10 and upper lip 12 are coupled, the sidelap 14 may include four layers of structural panel material, in which two of the layers are associated with the lower lip 10 and two of the layers are associated with the upper lip 12. In other embodiments of the invention the sidelap 14 may have additional layers to further improve the shear strength of the structural system. For example, a five layer sidelap, a six layer sidelap, or the like formed by having additional folds on the lower lip 10 (e.g., three layers) or on the upper lip 12 (e.g., three layers) may be utilized in the present invention. However, in some embodiments of the invention the fasteners or tools used to cut (e.g., shear, punch, or the like) a five layer sidelap, six layer sidelap, or the like may need additional power to cut the layers in the sidelap while still operating between adjacent top flanges 4 of adjacent panels 2 of the structural panels.

Figure 3:
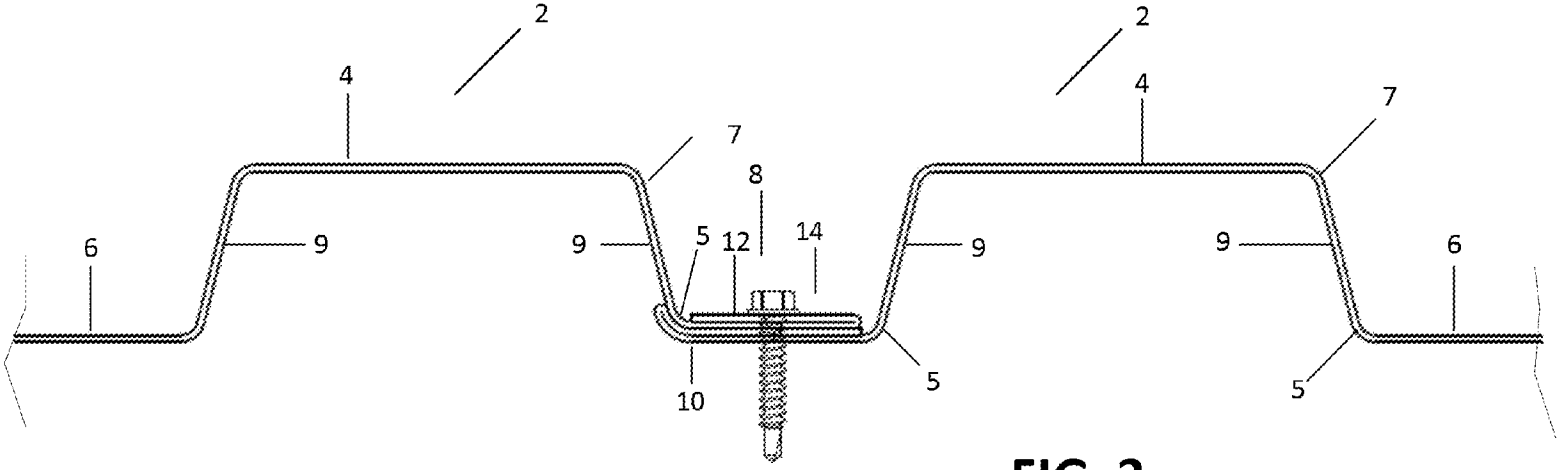
FIG. 3 illustrates a profile view of a portion of the structural panel system of FIG. 1 with a fastener coupling, in accordance with embodiments of the present invention.

In one embodiment of the invention the four layer sidelap (or three layer, five layer, six layer, or the like) may be coupled using fasteners. In one embodiment of the invention, as illustrated in FIGS. 3 and 4, the fasteners may be screws, such as self-drilling screws that drill apertures through the layers (e.g., four layers, or the like) using a lead portion of the screw, create aperture threads in one or more of the layers using a thread forming portion, and have fastener threads in a threaded portion that engage the aperture threads to create the coupling (also described as a joint, connection, attachment, or the like) between adjacent structural panels 2. In other embodiments of the invention, the fasteners may be other types of mechanical fasteners that are either hand-driven or power-driven (e.g., electrically, pneumatically, hydraulically, or the like) into the sidelap 14, such as other screws, nails, rivets, or the like. As illustrated in FIG. 2 the coupling creates an improved single shear coupling when compared to a two layer sidelap. Moreover, the sidelap created by the three or more layers of the present invention is much easier to assemble than an interlocking sidelap. As such, the sidelap with three or more nested layers of the present invention has the same or similar shear strength as an interlocking configuration and better shear strength than a two layer sidelap.

In another embodiment of the invention, the four layer sidelap (or three layer, five layer, six layer, or the like) may be welded (e.g., welded in the middle of the sidelap, edge-welded on the edges of the sidelap, or both) in order to create the coupling between adjacent structural panels 2. The weld may fuse portions of the upper lip 12 with portions of the lower lip 10 in the middle of the sidelap and/or along one or more edges of the lips. Additionally, in some embodiments, filler material may be added to form a pool of metal along with the metal from the upper lip 12 and the lower lip 10 in order to form an effective weld. A weld formed on the four layer sidelap 14 is an improvement over a two layer sidelap because of the additional layers of material provided in the lower lip 10 and/or the upper lip 12. When welding two layer sidelaps, burn through may occur when filler material burns through not only the single upper lip, but also through the single layer of the lower lip 10, which causes a defective weld. A defective weld may result in additional time for a welder to patch the weld, and even after patching the weld may not have the desired shear strength. The extra layer of material in the lower lip 10 and/or the upper lip 12 of the present invention allows for additional material that is less likely to be burned through during the welding process. Particularly, using a configuration in which the layers of the lower lip 10 and/or upper lip 12 touch (e.g., no gap) along at least of a portion of the width of the sidelap may be better than using a lower lip 10 and/or upper lip 12 that have gaps (not illustrated) during welding because burn through may be less likely when the layers are folded on top of each other with minimum or no gaps since there is little or no space between the layers to allow for burn through of the filler material. This is particularly true as the material thickness of the decking panels 2 become thinner.

In other embodiments of the invention, instead of a welded sidelap 14, as previously discussed, the four layer sidelap 14 may be deformed and/or cut (e.g., sheared) to couple the structural panels 2 together. In some embodiments of the invention a tool that punches through the sidelap 14 and folds one or more layers of the sidelap may be utilized to create the coupling. The tool may perform a cutting, displacement, and/or forming operation as well as a deformation operation that also deforms at least a portion of the sidelap 14. The tool may be manually actuated or actuated through a power source, such as but not limited to pneumatically actuated, hydraulically actuated, electromechanically actuated, or actuated using any other type of power source in order to create the coupling. Depending on the material thickness of the four layers (or other number of layers) of the sidelap 14, pneumatic or hydraulic actuation may be required in order to cut through the four layers (or other number of layers) of the sidelap 14. In one embodiment cutting, displacing, and/or forming the sidelap 14 comprises shearing and deforming a portion of the sidelap 14 to create a louver that results in a tab that provides interference at the ends of the tab to resist lateral movement of the adjacent panels. However, it should be understood that other embodiments may comprise other configurations for cutting the sidelap 14 to achieve the results described herein.

Lateral adjacent structural panels 2 may form four layer sidelaps (or other number of layers) along the edges of the structural panels 2; however, longitudinal adjacent structural panels 2 may either be butted up against each other, or may be overlaid on top of each other at the ends of the structural panels 2. When longitudinal adjacent structural panels 2 are butted up against each other an end gap may be formed, which may be sealed or otherwise left to be covered by a cementitious material or another type of material (e.g., in floor applications or wall applications), or by a waterproofing material or another roof or wall system that would cover the gap between longitudinal adjacent structural panels 2. When the ends of longitudinal adjacent structural panels 2 are overlaid on top of each other fasteners or other means for coupling the ends of the longitudinal adjacent structural panels 2 may be utilized. However, in some embodiments, overlaying the ends of the longitudinal adjacent structural panels 2 may create a double sidelap location, such as an eight-layer sidelap (e.g., when four layer sidelaps are used in lateral adjacent structural panels 2), six-layer sidelap (e.g., when three layer sidelaps are used in lateral adjacent structural panels 2), or other like number of layers based on the number of layers in a sidelap used in adjacent structural panels 2. In some embodiments of the invention, a coupling may be created at the eight-layer sidelap location (or other number of layers). As previously discussed with respect to the couplings in the four layer sidelap, the couplings used in the double sidelap location, such as the eight-layer sidelap location (or other number of layers) may be the same. However, in some embodiments of the invention a special fastener (e.g., self-drilling screw, pin, rivet, or the like) may be utilized to create a joint at the double sidelap location (e.g., in the eight-layer sidelap location, or other number of layers). In other embodiments a weld may be used as a coupling at the double sidelap location, while the same or different types of couplings may be used at other locations on the sidelaps 14. However, it may be difficult to create a proper weld at a sidelap that has eight layers (or other amount of layers greater or less than eight layers). Creating a coupling at the double sidelap location may further improve the shear strength of the sidelap 14 and structural panel system, thus allowing for a reduced thickness of the structural panels 2 or a reduction of the number of couplings used along a sidelap 14 or within the structural system. However, in some embodiments the structural system (e.g., connection between longitudinal adjacent structural panels 2) may be formed without a coupling at the double sidelap location, and the improvements of the shear strength and/or flexibility described herein may be still be achieved.

Figure 5:
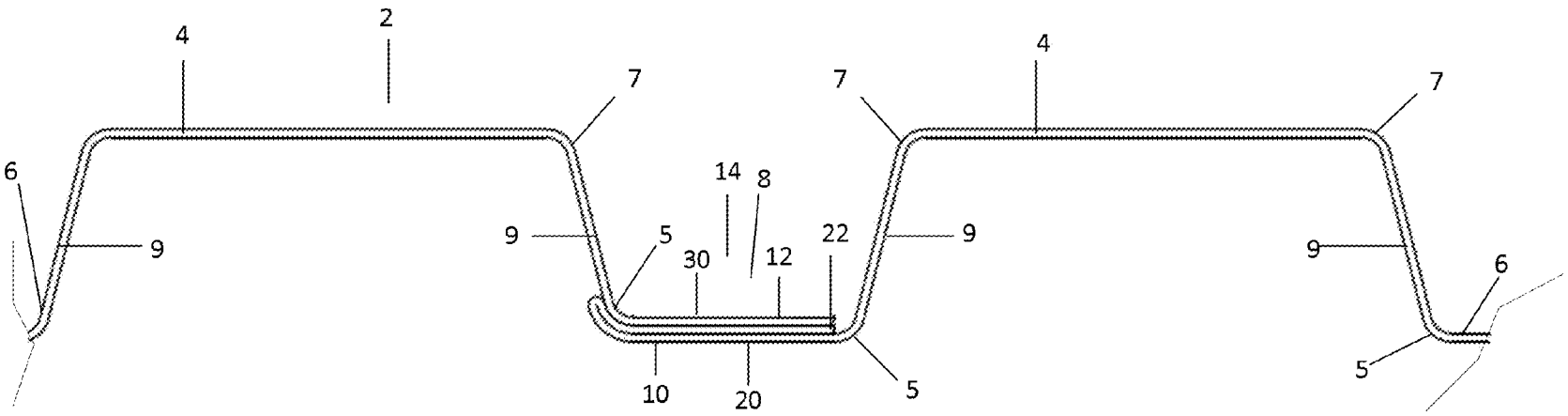
FIG. 5 illustrates a profile view of a portion of a structural panel system having a sidelap with a one-layer upper lip placed over a two layer lower lip, in accordance with embodiments of the present invention.
Figure 6:
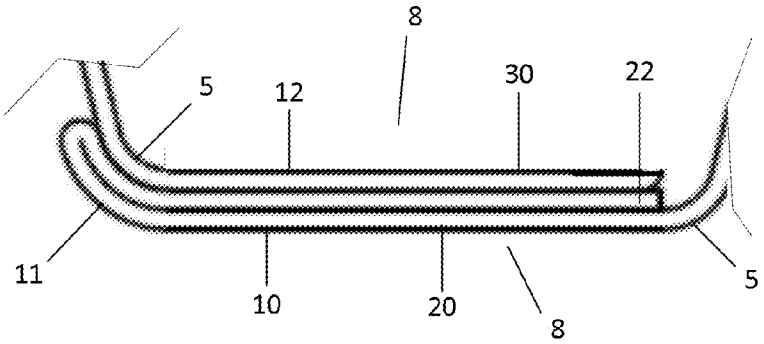
FIG. 6 illustrates an enlarged view of the profile of the sidelap of the structural panel system illustrated in FIG. 5, in accordance with embodiments of the present invention.

As illustrated in FIGS. 5 and 6, in some embodiments of the invention, the upper lip 12 may only have a single first upper lip layer 30, while the lower lip 10 may comprise the first lower lip layer 20 and the second lower lip layer 22 previously described above. As such, as illustrated in FIGS. 5 and 6 the upper lip 12 and the lower lip 10 form a sidelap 14 with a total of three layers. As previously discussed with respect to the four layer sidelap, a lower lip 10 may comprise a nested portion 11 in which the upper lip 10 and/or the lower flange corner 5 rests. Moreover, as previously discussed the upper lip 12 may also have an upper nested portion (not illustrated) that may also rest within a lower flange corner 5, as previously discussed.

Figure 7:
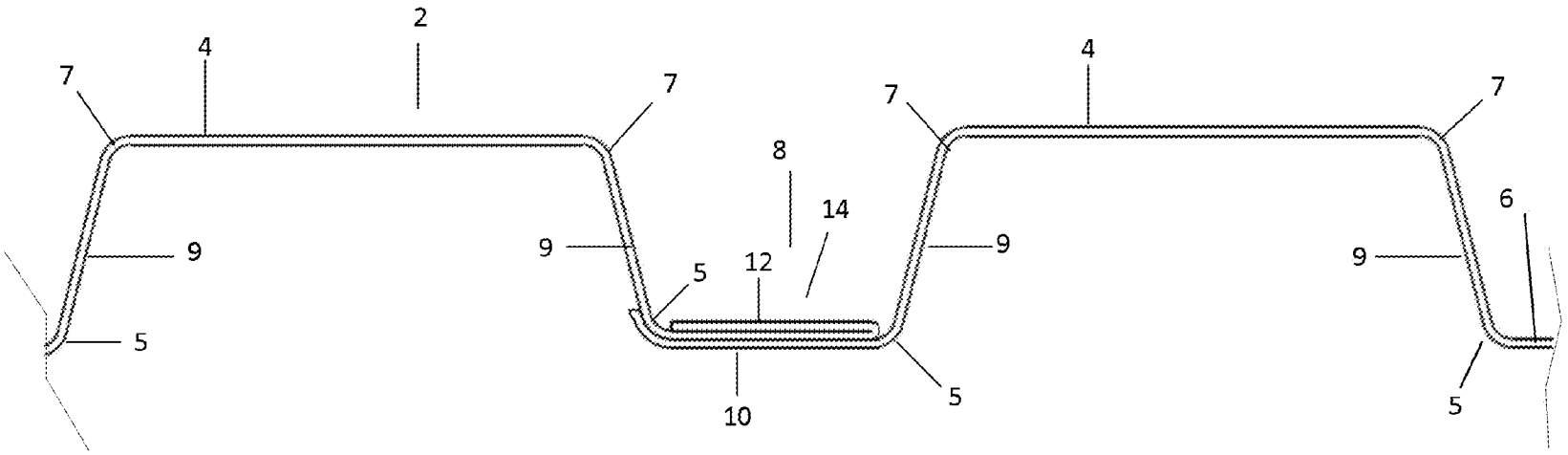
FIG. 7 illustrates a profile view of a portion of a structural panel system having a sidelap with a two layer upper lip placed over a one-layer lower lip, in accordance with embodiments of the present invention.
Figure 8:
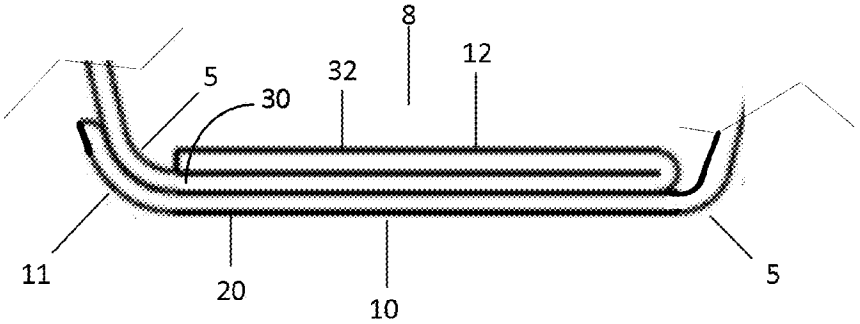
FIG. 8 illustrates an enlarged view of the profile of the sidelap of the structural panel system illustrated in FIG. 7, in accordance with embodiments of the present invention.

As illustrated in FIGS. 7 and 8, in some embodiments of the invention, the lower lip 10 may only have a single first lower lip layer 20, while the upper lip 10 may comprise the first upper lip layer 30 and the second upper lip layer 32 previously described above. As such, as illustrated in FIGS. 7 and 8 the upper lip 12 and the lower lip 10 form a sidelap 14 with a total of three layers. As previously discussed with respect to the four layer sidelap, the lower lip 10 may comprise a nested portion 11 in which the upper lip 10 and/or the lower flange corner 5 rests. Moreover, as previously discussed, the upper lip 12 may also have an upper nested portion (not illustrated) that may also rest within a lower flange corner 5.

As previously described with respect to the four layer sidelap above, couplings may be formed within the un-joined sidelap 14 in order to create the joined sidelap 14. As such, the couplings may comprise fasteners (e.g., self-drilling screws, nails, rivets, or the like), a welded sidelap, a cut sidelap, or the like.

Figure 9A:
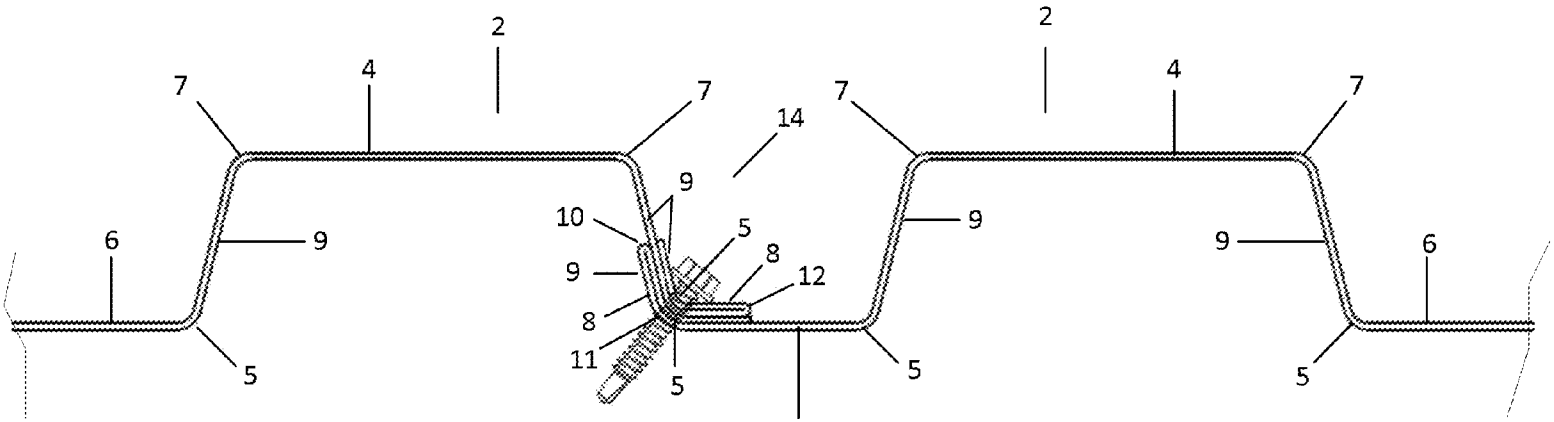
FIG. 9A illustrates a profile view of a portion of a structural panel system having a sidelap with a two layer upper corner lip placed over a two layer lower corner lip and a corner fastener, in accordance with embodiments of the present invention.
Figure 9B:
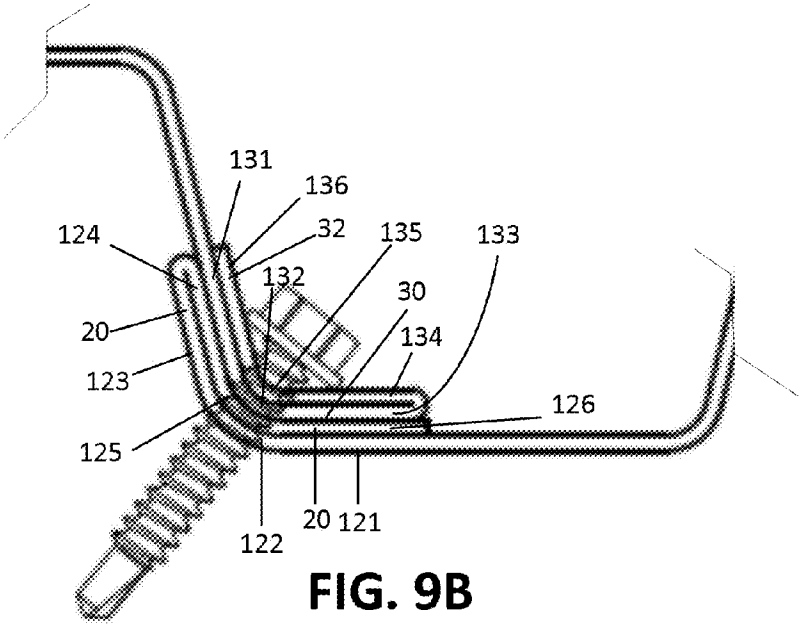
FIG. 9B illustrates an enlarged view of the profile of the sidelap of the structural panel system illustrated in FIG. 9A, in accordance with embodiments of the present invention.

FIGS. 9A and 9B illustrate another embodiment of the invention, in which the sidelap 14 is formed around the lower flange corner 5 of one of the structural panels 2. As illustrated in FIG. 9A, in one embodiment a first structural panel 2 may comprise an edge 8 with an upper lip 12 formed around the lower flange corner 5. The upper lip 12 may comprise a first upper lip layer 30 formed from a first upper portion 131 (e.g., a portion of a web 9), a second upper portion 132 (e.g., lower flange corner 5), and a third upper portion 133 (e.g., a portion of a lower flange 6 located at the edge 8 of the panel 2). The upper lip 12 may also comprise a second upper lip layer 32 that is folded back upon the first upper lip layer 30 formed by a fourth upper portion 134 (e.g., portion folded back upon the third upper portion 133, such as a portion of the lower flange 6 at the edge 8 of the structural panel 2), a fifth upper portion 135 (e.g., folded back upon the second upper portion 132, such as the lower flange corner 5), and a sixth upper portion 136 (e.g., folded back upon the first upper portion 131, such as the portion of the web 9). As illustrated in FIG. 9A, in one embodiment a second structural panel 2 may comprise an edge 8 with a lower lip 10 forming a nested portion 11 in which the upper lip 12 rests. The lower lip 10 may comprise a first lower lip layer 20 formed from a first lower portion 121 (e.g., a portion of a bottom flange 6), a second lower portion 122 (e.g., lower flange corner 5), and a third lower portion 123 (e.g., a portion of a web 9). The lower lip 10 may also comprise a second lower lip layer 22 that is folded back upon the first lower lip layer 20 formed by a fourth lower portion 124 (e.g., portion folded back upon the third upper portion 123, such as a portion of the web 9), a fifth lower portion 125 (e.g., folded back upon the second lower portion 122, such as a portion of the lower flange corner 5), and a sixth lower portion 126 (e.g., folded back upon the first lower portion 121, such as the portion of the bottom flange 6).

As such, the un-joined sidelap 14 in some embodiments may be formed in multiple planes around a lower flange corner 5, such as in-plane with the lower flange 6 formed between adjacent structural panel edges 8, at an angle from the lower flange 6 and in-plane with a web 9, and around a lower flange corner 5. The coupling formed in the sidelap 14 illustrated in FIGS. 9A and 9B may be formed in multiple portions of the sidelap 14, such as in-plane with the bottom flange 6 formed between adjacent structural panels 2, in-plane with the web 9, and/or in the lower flange corner 5 (as illustrated in FIGS. 9A and 9B). The corner sidelap 14 illustrated in FIGS. 9A and 9B may provide for improved strength because not only does it have four layers but it has two portions of the four layer sidelap 14 that are located in different planes and a third portion that operatively couples the two portions that are located in different planes. As such, the sidelap 14 has stiffening elements in two different orientations (e.g., the two planes). In other embodiments as previously discussed with respect to the sidelaps in FIGS. 5-8, the corner sidelap 14 may only have three layers (e.g., a single first upper layer 30 in the upper lip 12 or a single first lower layer 20 in the lower lip 10).

Figure 10A:
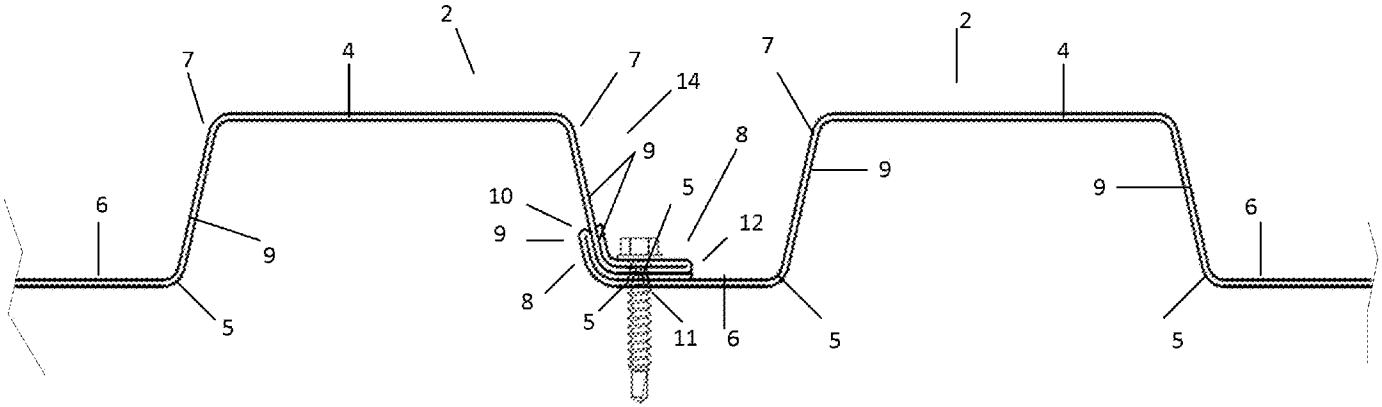
FIG. 10A illustrates a profile view of a portion of a structural panel system having a side-lap with a two layer upper corner lip placed over a two layer lower corner lip and a lip fastener, in accordance with embodiments of the present invention.
Figure 10B:
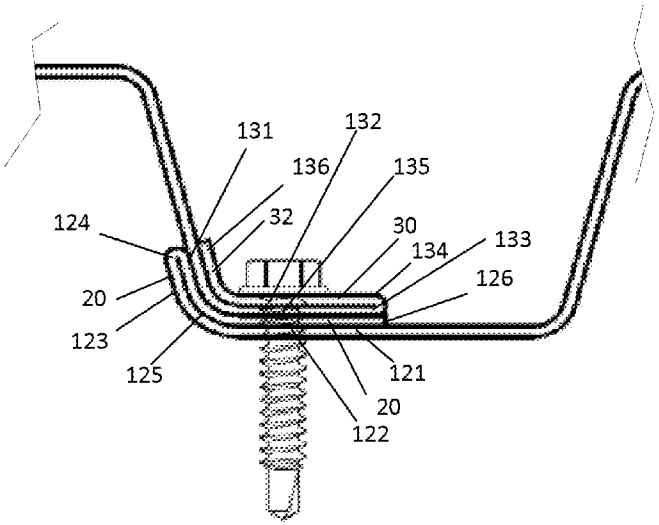
FIG. 10B illustrates an enlarged view of the profile of the side-lap of the structural panel system illustrated in FIG. 10A, in accordance with embodiments of the present invention.

FIGS. 10A and 10B illustrate the same sidelap that was illustrated and discussed with respect to FIGS. 9A and 9B; however, FIGS. 10A and 10B illustrate that the coupling (e.g., the fastener) is formed in the lower flange 6 instead of in the corner 5 as illustrated in FIGS. 9A and 9B. By forming the coupling in the lower flange 6 the panel system may have a more traditional view from below, and/or the coupling and/or the sidelap may have better performance (e.g., strength, or the like) than if the coupling is formed in the corner 5.

Figure 11:
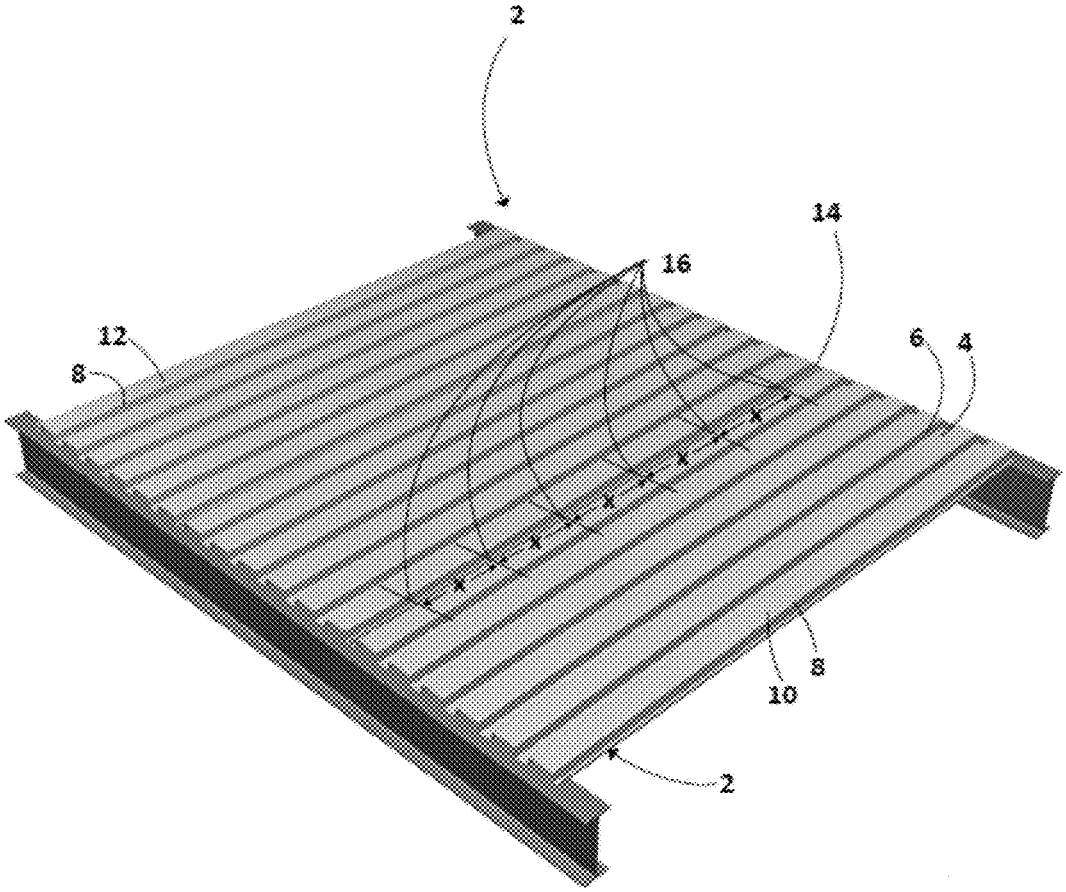
FIG. 11 illustrates a spacing of couplings along the sidelap of two operatively coupled panels, in accordance with embodiments of the present invention.

The different types of overlapping sidelaps (e.g., four layer sidelap, three layer sidelap, four layer corner sidelap, three layer corner sidelap, or any number of layers greater than four in the sidelaps discussed herein) described herein may result in different strengths, and as such, different spacing of the couplings or thicknesses of the panels in order to achieve the same shear strength of the sidelap 14 and/or structural system. The couplings in the sidelap 14 may be installed along the sidelap 14 at strategic distances from adjacent couplings. As depicted in FIG. 11, couplings may be installed at a predetermined distance "X" from each other. The value of "X," may range from 4 inches to 60 inches along the sidelap 14 based on the material thickness of the panels 2, the desired shear strength and/or stiffness of the structural panel system, the type of couplings being formed (e.g., type of fasteners, weld, type of cut connection, or the like), or other like factors. However, the range of the distance between couplings may be within the stated range, fall outside of the stated range, or overlap the stated range. The couplings may be installed using a generally uniform distance from each other, such that the distance "X" described may vary slightly, or may change over different locations on the sidelap depending on the requirements of each structural system. As such, the number of couplings and the locations of the couplings may vary within a panel length, between different panels, between supports, or in different zones throughout the structural system. Installing couplings in an optimal pattern along the sidelap 14 may be based on a balance between the desired stability and shear strength of the structural panel system, the flexibility of the structural system, and the installation time of the structural system.

Creating couplings in the sidelaps 14 of the structural panel system described herein improves the shear strength of the sidelaps 14 and/or structural system over two layer nested sidelaps, or three layer standing sidelaps. As such, because of the improved shear strength in the sidelap 14 of the present invention, thinner material thicknesses may be used for the panels 2 and/or fewer couplings are needed to create a structural panel system that has a shear strength that is the same as or similar to the shear strength of a structural system with a two layer nested sidelap or a three layer standing interlocking sidelap, or other type of standing (e.g., out-of-plane) sidelap. For example, the four layer in-plane nested sidelap 14 of the present invention has improved shear strength over a three layer in-plane nested sidelap 14 described in the present invention. Moreover, the four layer in-plane nested sidelap 14 and the three layer in-plane nested sidelap 14 described in the present invention is an improvement over two layer overlapping in-plane nested sidelaps 14, as well as over three layer standing interlocking sidelaps. In some embodiments, the more layers used in the sidelaps 14 may provide a shear strength improvement over a lower number of layers in the sidelaps 14. In still other embodiments of the invention, the four layer or three layer sidelaps corner sidelaps 14 described herein (as illustrated in FIGS. 9A, 9B, 10A, and 10B) may provide a shear strength improvement over other types of sidelaps described herein (e.g., four or three layer in-plane sidelaps 14), or other sidelaps, such as two layer in-plane nested sidelaps or three layer standing sidelaps. As such, using structural systems with the four layer or three layer in-plane and/or corner sidelaps 14 discussed herein may result in structural systems that cost less due to reduced material costs (e.g., reduced price for thinner steel structural panels) and due to reduced assembly costs (e.g., assembly time is reduced due to less couplings) over other sidelaps.

Table 1 illustrates factor improvements for the diaphragm shear strength improvements that three layer and four layer overlapping sidelaps have over two layer sidelaps for structural decking systems with different panel thicknesses, and using different types of self-drilling screws as the couplings.

TABLE 1

Three Layer and Four layer In-Plane Sidelap Diaphragm Shear Strength Improvements over Two Layer In-Plane Sidelap Diaphragm Shear Strength

| | | Strength Increase | |
|---|---|---|---|
| Gage | Fastener Size | 3-Layer* | 4-Layer |
| 22 | No. 8 | 1.51 | 2.83 |
| | No. 10 | 1.62 | 2.83 |
| | No. 12 | 1.73 | 2.83 |
| | No. 14 | 1.86 | 2.83 |
| 20 | No. 8 | 1.38 | 2.75 |
| | No. 10 | 1.48 | 2.83 |
| | No. 12 | 1.58 | 2.83 |
| | No. 14 | 1.70 | 2.83 |
| 18 | No. 8 | 1.19 | 2.38 |
| | No. 10 | 1.28 | 2.56 |
| | No. 12 | 1.37 | 2.73 |
| | No. 14 | 1.47 | 2.83 |
| 16 | No. 8 | 1.06 | 2.13 |
| | No. 10 | 1.15 | 2.29 |
| | No. 12 | 1.22 | 2.44 |
| | No. 14 | 1.31 | 2.63 |

*The 3-layer has one upper lip layer and two lower lip layers. The results for having two upper lip layers and one lower lip layer may be the same or may be different.

It should be understood that utilizing an overlapping sidelap of the present invention described herein (e.g., four layer, three layer, corner sidelap, or other layer sidelap greater than three layers) may improve the shear strength of the sidelap and/or structural panel system over a two layer sidelap and/or structural panel system by a factor of 1.01, 1.02, 1.03, 1.04, 1.05, 1.06, 1.07, 1.08, 1.09, 1.10, 1.11, 1.12, 1.13, 1.14, 1.15, 1.16, 1.17, 1.18, 1.19, 1.20, 1.21, 1.22, 1.23, 1.24, 1.25, 1.30, 1.35, 1.40, 1.45, 1.50, 1.55, 1.60, 1.65, 1.70, 1.75, 1.80, 1.85, 1.90, 1.95, 2.00, 2.10, 2.20, 2.30, 2.40, 2.50, 2.60, 2.70, 2.8, 2.9, 3.00, 3.50, 4.00 or more. In other embodiments the improvement may be outside of, within, or overlapping any numbers within this factor range.

Generally, because of the additional strength at the four layer sidelap 14 the overall structural panel system may be less flexible when compared the same structural panel system with a two layer sidelap. As such, in some applications of the structural panel system in some types of building structures, it may be desirable to improve the flexibility (e.g., reduce stiffness) at the expense of the shear strength. As such, the sidelaps of the present invention may facilitate the ability to improve flexibility without degrading the shear strength. Improvements in the flexibility may be achieved through a number of different ways, such as using the generally in-plane sidelap of the present invention and reducing the thickness of the structural panels 2 (e.g., over a two layer in-plane sidelap, standing sidelaps, or other types of sidelaps), reducing the number of couplings in the sidelap 14, or the like, all of which can be achieved while maintaining the desired shear strength of the sidelaps 14 or structural panel systems because of the four layer sidelap (or other sidelap discussed herein). As such, not only may the four layer sidelap 14 structural panel systems of the present invention be utilized to increase the shear strength when compared to two layer sidelap structural panel systems, but it may also be used to increase the flexibility of the structural systems while keeping the shear strength the same or similar to two layer sidelap configurations. For example, by reducing the thickness of the decking panels, the present invention including a four layer sidelap 14 may have the same or similar shear strength and flexibility as a two layer sidelap having thicker decking panels. As such, the four layer sidelap 14 of the present invention can reduce costs without sacrificing shear strength and/or stiffness of the decking system. Alternatively, as discussed herein, using the four layer sidelap 14 of the present invention can increase the stiffness without affecting the costs because the number of couplings and/or the thickness of the decking panels remain unchanged. The improvement of the present invention is due in part to creating a coupling through four layers, which is stiffer than creating a coupling through two layers. The values for Table 1, and discussion thereof, are described as being related to decking systems, but it should be understood that the same principals would also apply to wall systems.

As previously discussed the increased shear strength utilizing the four layer in-plane sidelap, or other sidelap discussed herein, may be an improvement over a two layer in-plane sidelap (or in other embodiments a three layer standing sidelap) because using the four layer sidelap may allow a four layer sidelap system, or other sidelap discussed herein, to drop gage thicknesses (e.g., move from 18 gage to 20 gage, or the like) without sacrificing shear strength. In some embodiments of the invention, a reduction in the thickness of the panels (e.g., a drop down in the gage thickness from 18 to 20, or any other drop) may not be achieved without also increasing the number couplings used in the four layer sidelap, or other sidelaps discussed herein. This would only occur when a reduction in the thickness of the panels using a four layer sidelap, or other sidelaps discussed herein, with the same number of couplings as a two layer sidelap (or a three layer standing sidelap) using the thicker panels would not result in the same shear strength or the desired shear strength. Adding additional couplings in the four layer sidelap, or other sidelaps discussed herein, may achieve the desired shear strength, while still reducing costs because the material is less expensive (e.g., thinner structural panels), even though creating the additional couplings in the sidelap may increase the cost of assembly (e.g., if the cost of inserting the fasteners of the present invention were less than the cost savings of the thinner structural panels). As such, in some embodiments of the invention, depending on the material thickness of the panels, the length of the sidelap, the type of four layer sidelap, or other sidelaps herein, the type of couplings, or other like parameters, the thickness (or in other embodiments of the invention the weight) of the panels may be reduced by 5, 10, 15, 20, 25, 30, 35, 40, 45, 50, 55, 60, 65, 70, 75, 80, 85, 90, 95, 100, 110, 120, 130, 150, or more percent, while still achieving the same shear strength as a two layer sidelap (or a three layer standing interlocking or abutting sidelap) that utilizes the same, more, or in some cases less couplings. As illustrated in FIG. 11, the thickness of the panels 2 of the structural panel system may be reduced using the four layer sidelap 14, while the number of couplings along the sidelap 14 between the two panels 2 of a structural system remain the same (e.g., the distance "X" does not change with respect to a two layer sidelap), are reduced, or in some embodiments are increased. This reduces the weight of the structural panels 2 and the amount of steel used, which results in lower costs associated with the structural systems. In some embodiments, the thicknesses of the panels 2 and/or the number of couplings used in the four layer sidelap systems (or other systems using the sidelaps described herein), when compared to the two layer sidelap systems (or three layer standing sidelap systems), may be reduced to improve the cost, weight, assembly time, and safety of the systems while achieving the same or similar shear strengths, or in some cases greater shear strengths depending on the requirements of the building.

As previously discussed, any type of structural profile may utilize the sidelaps 14 described in the present invention in order to improve the shear strength along the sidelap, and thus, reduce the thickness of the material used in a structural system and/or reduce the number of couplings used to couple the structural panels 2 together in a structural panel system.

Figure 12A:
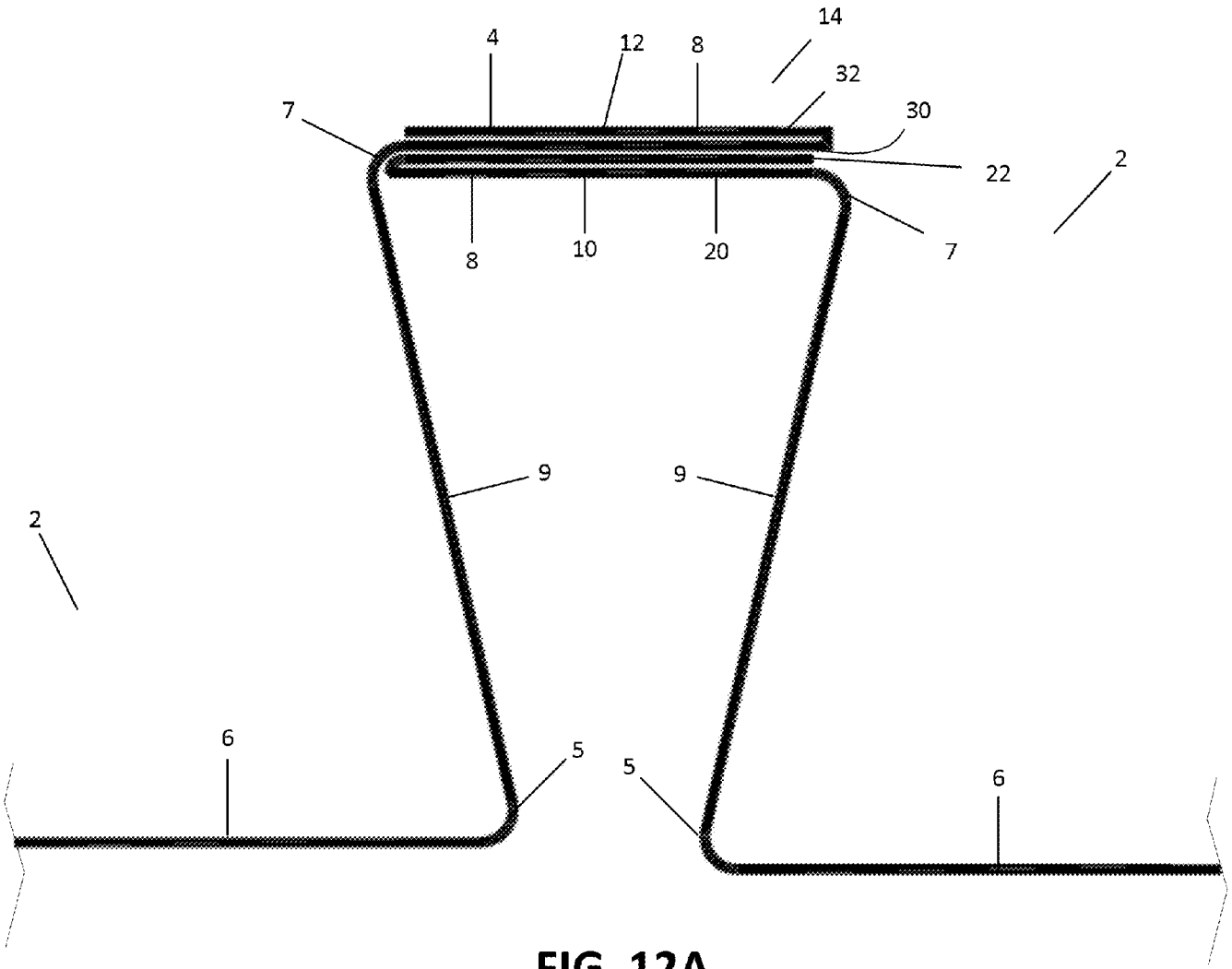
FIG. 12A illustrates a dovetail profile for a structural panel system having a sidelap with a two layer upper lip placed over a two layer lower lip, in accordance with embodiments of the present invention.
Figure 12B:
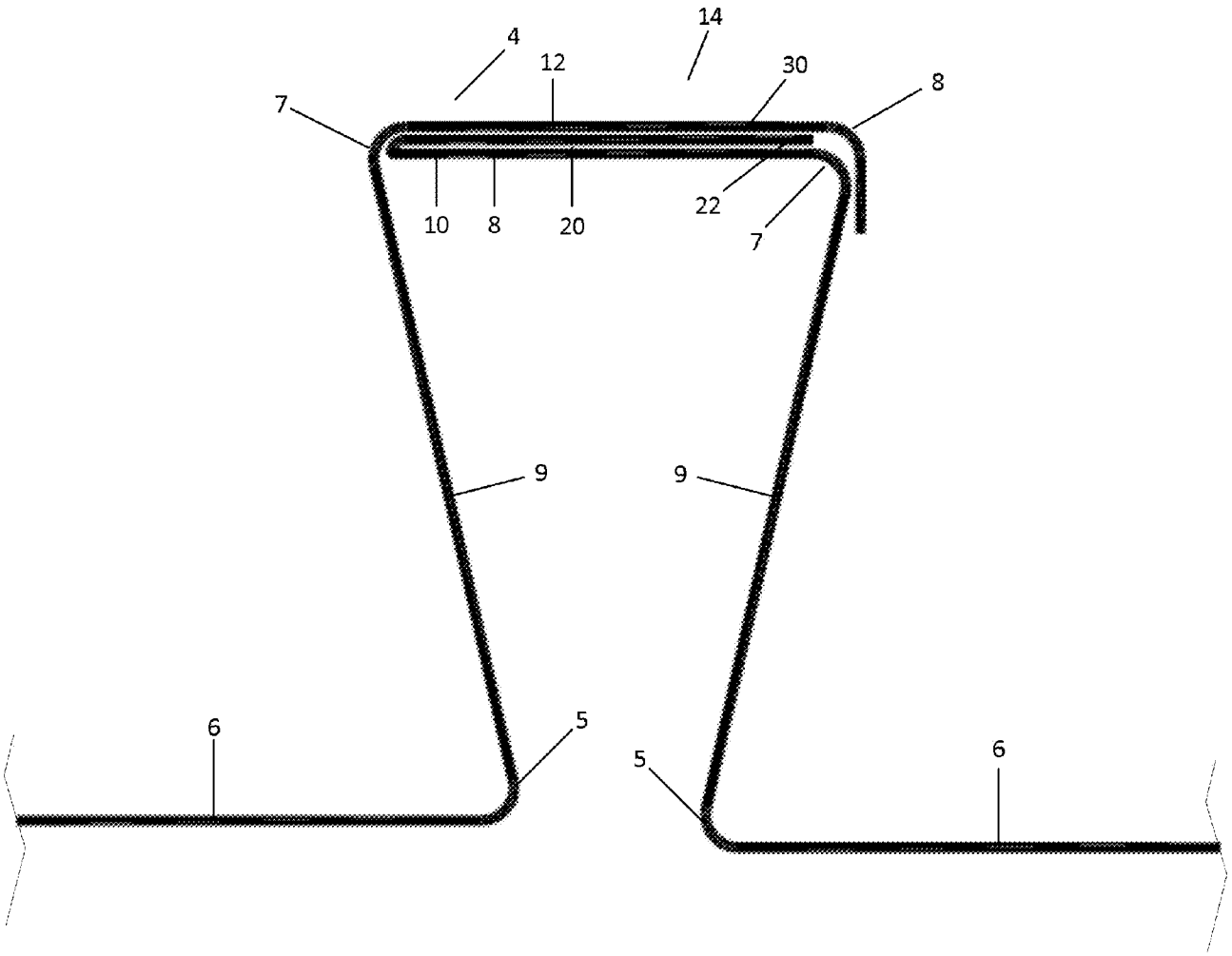
FIG. 12B illustrates a dovetail profile for a structural panel system having a sidelap with a one-layer upper lip placed over a two layer lower lip, in accordance with embodiments of the present invention.
Figure 12C:
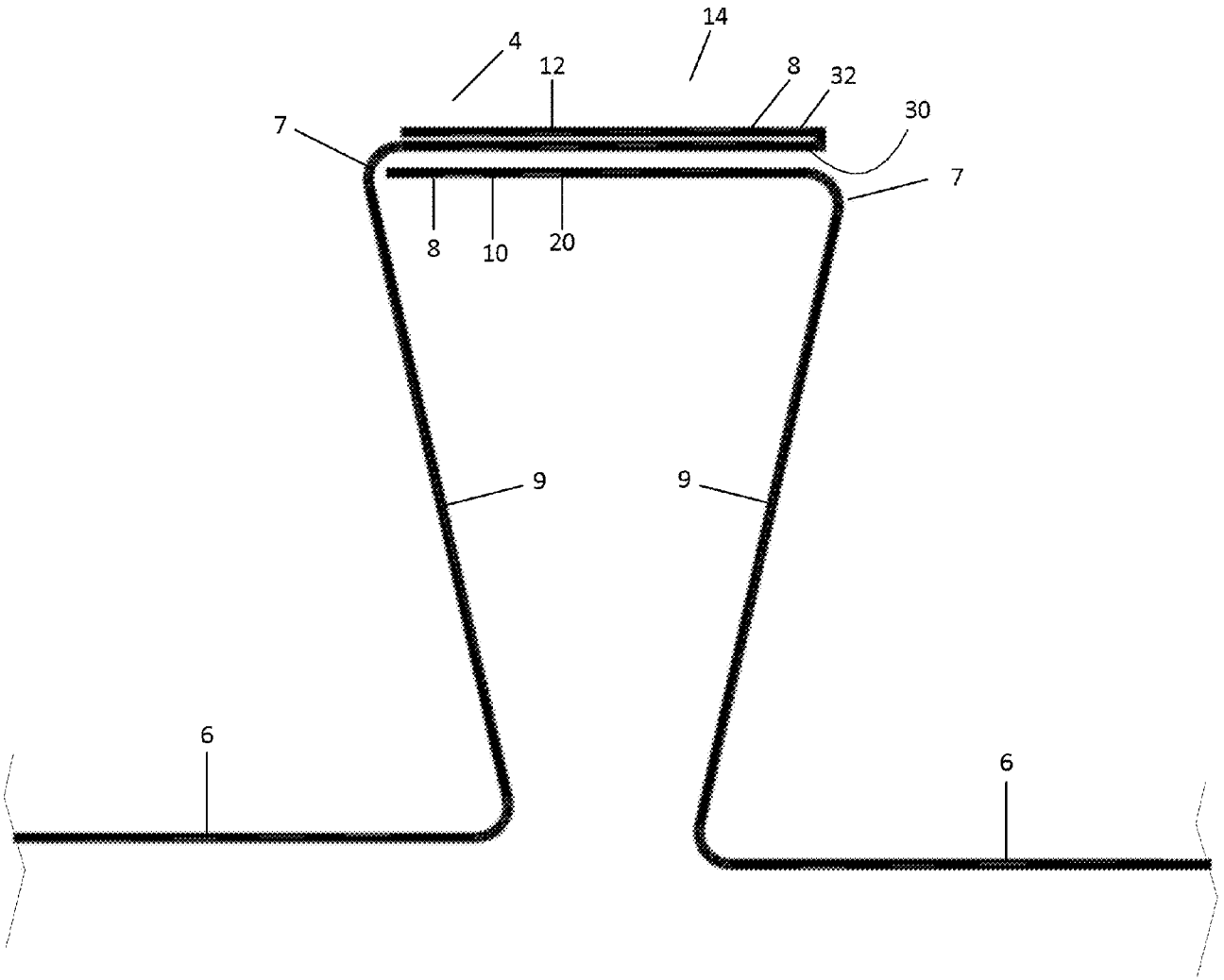
FIG. 12C illustrates a dovetail profile for a structural panel system having a sidelap with a two layer upper lip placed over a one-layer lower lip, in accordance with embodiments of the present invention.

FIGS. 12A-12C illustrate a dovetail profile, in accordance with one embodiment of the invention. As illustrated in the dovetail profile of FIGS. 12A-12C, in some embodiments, the sidelap 14 may occur in the top flange 4 of the panels 2 instead of the bottom flange 6 as previously discussed herein. Moreover, as previously discussed with respect to the sidelap 14 located in the bottom flange 6, the sidelap 14 in the top flange 4 of the panels 2 may comprise a total of three or more layers. For example, as illustrated in FIG. 12A the lower lip 10 and the upper lip 12 may have two layers of material with one-layer folded inwardly or outwardly, as previously discussed with respect to the sidelap 14 in FIGS. 1 and 2. In other embodiments, as illustrated in FIG. 12B the lower lip 10 may comprise two layers of material with one layer folded inwardly or outwardly, and the upper lip 12 may comprised one-layer of material, as previously discussed herein with respect to the sidelap 14 in FIGS. 5 and 6. In other embodiments, as illustrated in FIG. 12C the lower lip 10 may comprise one-layer and the upper lip 12 may comprise two layers of material with one-layer folded inwardly or outwardly, as previously discussed herein with respect to FIGS. 7 and 8. As previously discussed herein with respect to FIGS. 1-8 the lower lip 10 and/or the upper lip 12 may comprise a nested portion, in which the opposing lip, or a portion thereof, may be nested (e.g., as illustrated in FIG. 12B). In other embodiments of the invention, an upper flange corner 7 may be nested within at least a portion of the upper lip 12 and/or at least a portion of the lower lip 10 may be nested within an upper flange corner 7.

Figure 13A:
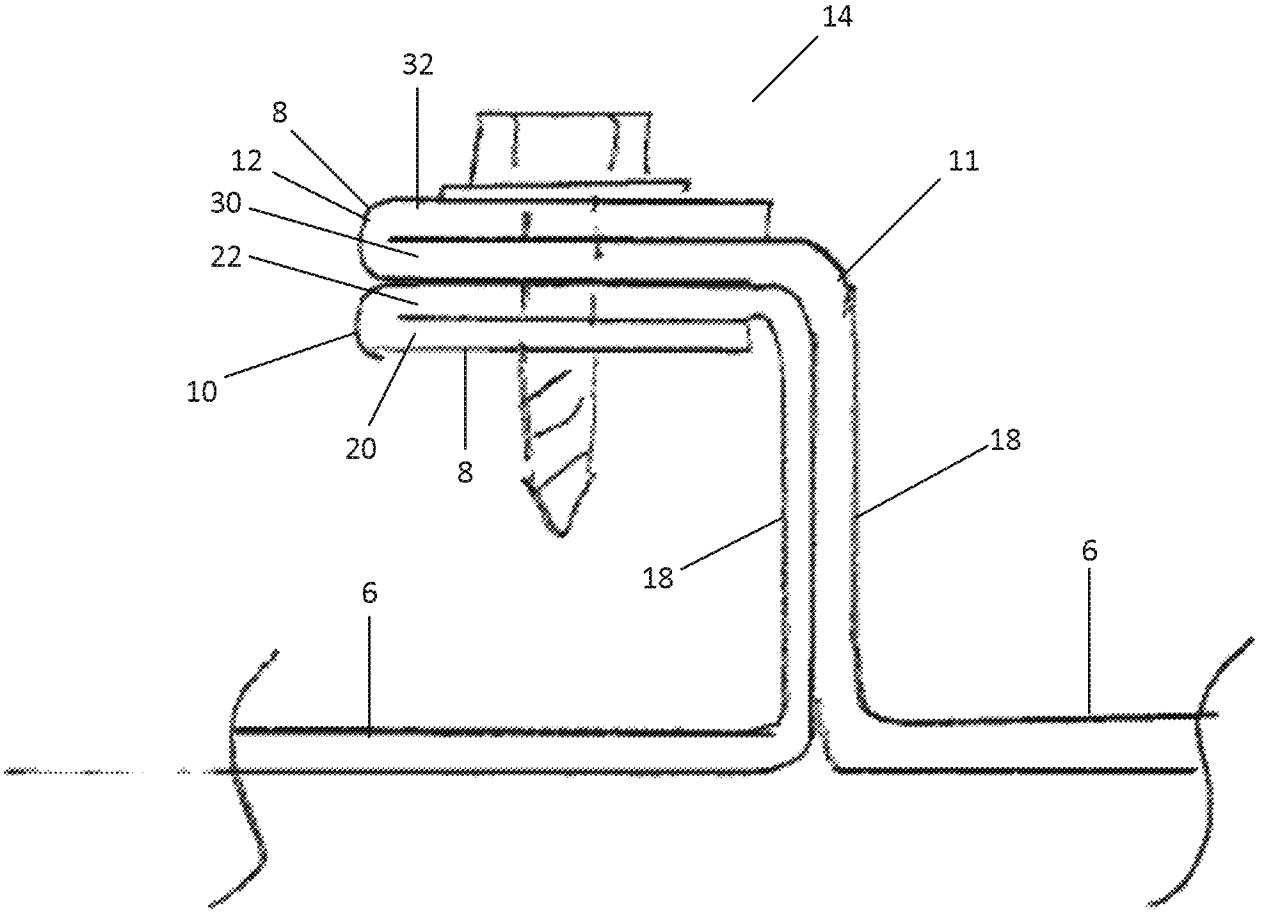
FIG. 13A illustrates a hidden offset sidelap for a structural panel system having a two layer upper lip placed over a two layer lower lip and offset from the panel flange, in accordance with embodiments of the present invention.

FIG. 13A illustrates another type of sidelap 14 that may be utilized in different types of profiles, regardless of whether or not the profiles are specifically discussed herein. In one embodiment the sidelap 14 in FIG. 13A may be of particular use in cellular structural panels 2 in order to hide fasteners, or other couplings. As illustrated by FIG. 13A the sidelap may comprise a concealed offset sidelap 14 comprising of a standing sidelap portion 18, and lower lip 10 and upper lip 12 portions that are parallel (or generally parallel within +/−45 degrees of parallel) with the structural panels 2 (e.g., the bottom flange 6, top flange 4, or the like), but are offset from the bottom flange 6 and/or top flange 4. In some embodiments, as illustrated in FIG. 13A the lower lip 10 and/or the upper lip 12 may each have two-layers, or one or the other may have two layers, such that the sidelap 14 may have a total of three or more layers. As previously discussed, with respect to the other sidelaps 14, the lower lip 10 and/or the upper lip 12 may have nested portions that may allow for nesting of different portions of the lips 10, 12 within the other lip. Moreover, the couplings may be made within the sidelap 14 illustrated in 13A in order to hide the couplings from the bottom of the structural system (e.g., from within the building in roof decking applications, or from within or outside of the building in wall systems depending on how the wall panels are installed). As illustrated in the FIG. 13A the coupling is illustrated as a fastener and the fastener is hidden from the below the structural panels 2.

Figure 13B:
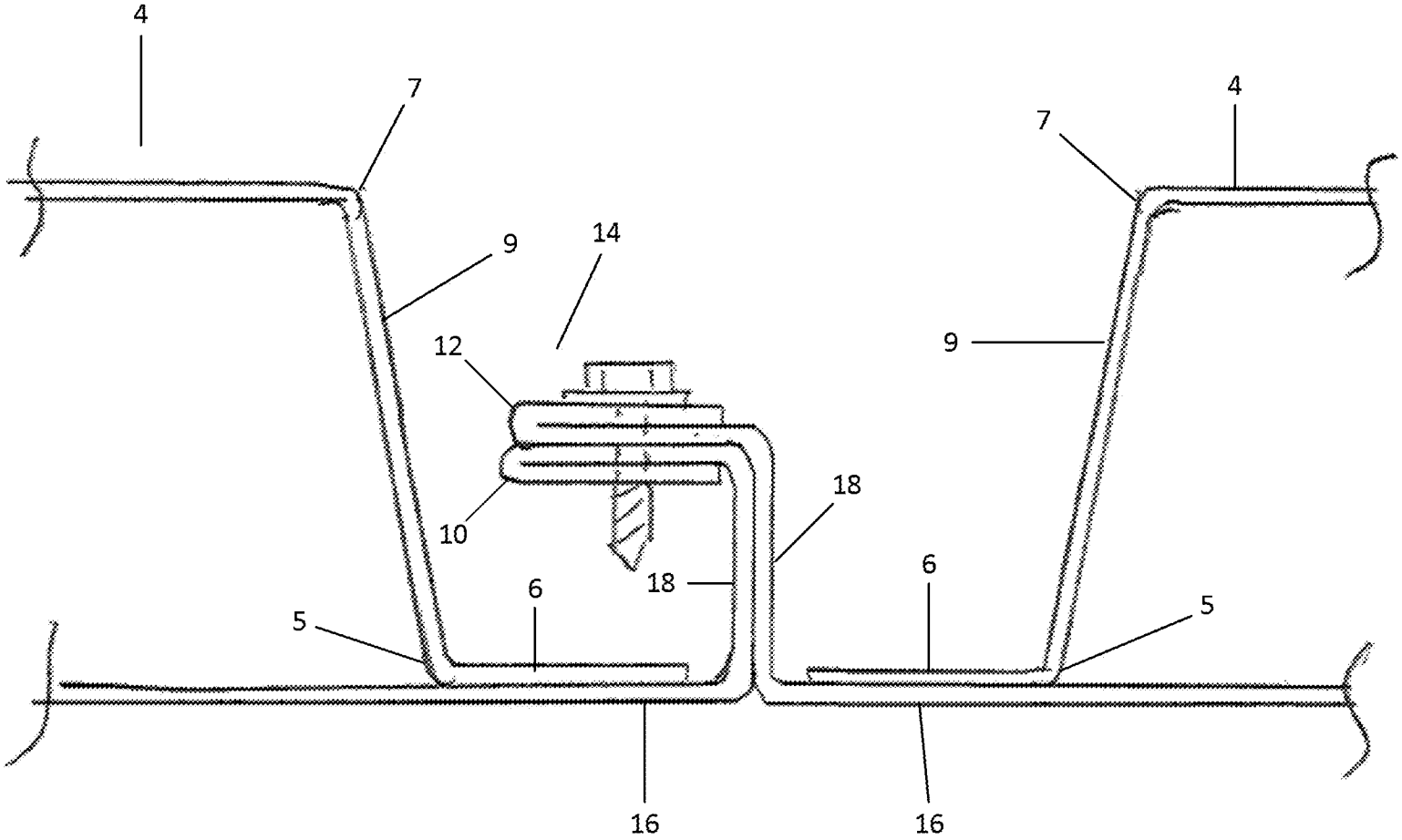
FIG. 13B illustrates a cellular structural panel profile with a hidden offset sidelap for a structural panel system having a two layer upper lip placed over a two layer lower lip, in accordance with embodiments of the present invention.

FIG. 13B illustrates a cellular structural profile that utilizes the concealed nested sidelap 14, as discussed with respect to FIG. 13A. However, as illustrated in FIG. 13B, the structural panels 2 do not include the sidelap 14, and instead the sidelap 14, and components thereof, are integrated into a bottom pan 16 (otherwise described as a bottom sheet or flat sheet) 16 that conceal at least one side of the structural panels 2 in order to conceal the sidelap and the fluted portions of the structural systems (e.g., the top flange 4, the bottom flanges 6, and the webs 9). The bottom pan 16 may be operatively coupled to the structural panels, which in combination act as a structural component of the system, may be provided for appearance by covering other components in the system, and/or may provide noise abatement when the bottom pan 16 is perforated.

Figure 14A:
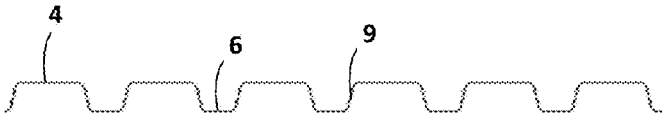
FIG. 14A illustrates a profile view of a structural panel, in accordance with embodiments of the present invention.
Figure 14B:
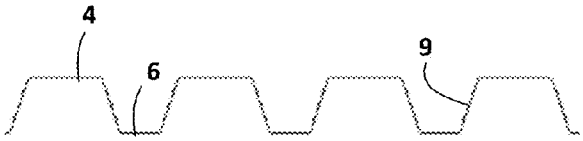
FIG. 14B illustrates a profile view of a structural panel, in accordance with embodiments of the present invention.
Figure 14C:
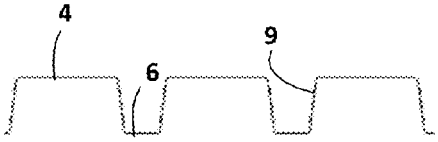
FIG. 14C illustrates a profile view of a structural panel, in accordance with embodiments of the present invention.
Figure 14D:
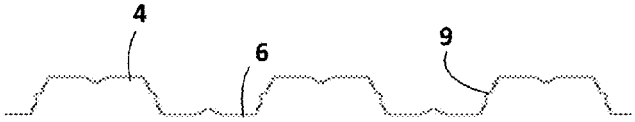
FIG. 14D illustrates a profile view of a structural panel, in accordance with embodiments of the present invention.
Figure 14E:
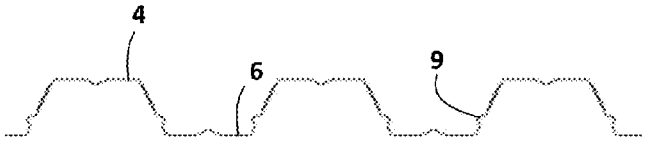
FIG. 14E illustrates a profile view of a structural panel, in accordance with embodiments of the present invention.
Figure 14F:
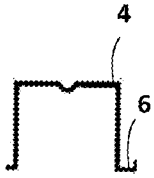
FIG. 14F illustrates a profile view of a portion of a structural panel, in accordance with embodiments of the present invention.
Figure 14G:
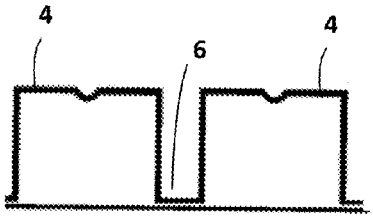
FIG. 14G illustrates a profile view of a portion of a structural panel with a cover, in accordance with embodiments of the present invention.

FIGS. 14A through 14G illustrate some of the structural profiles that may utilize the sidelaps 14 of the present invention. FIGS. 14A through 14G illustrate different types of profiles that have top flanges 4, bottom flanges 6, lower flange corners 5, upper flange corners 7, webs 9, as well as cutouts and/or longitudinal ribs, which impact the moment of inertia and section modulus of the panels 2. The illustrated structural panel profiles are only some of the structural profiles and it should be understood that any structural panels 2 having any type of profile (e.g., triangular, square, trapezoidal, dovetail, or the like) may utilize the sidelaps 14 and couplings described herein in order to provide improved shear strength of the structural systems. The profiles illustrated in FIG. 14F illustrates a single top flange 4, however it should understood that the profile illustrated in FIG. 14F (as well as the other profiles illustrated and described herein, including but not limited to FIGS. 14A-142G) may have one or more top flanges 4 and one or more bottom flanges 6. Moreover, as illustrated in FIG. 14G, in some embodiments of the invention the profiles described herein may include one or more bottom pans 16 (otherwise described as a bottom sheet, or the like).

Figure 15:
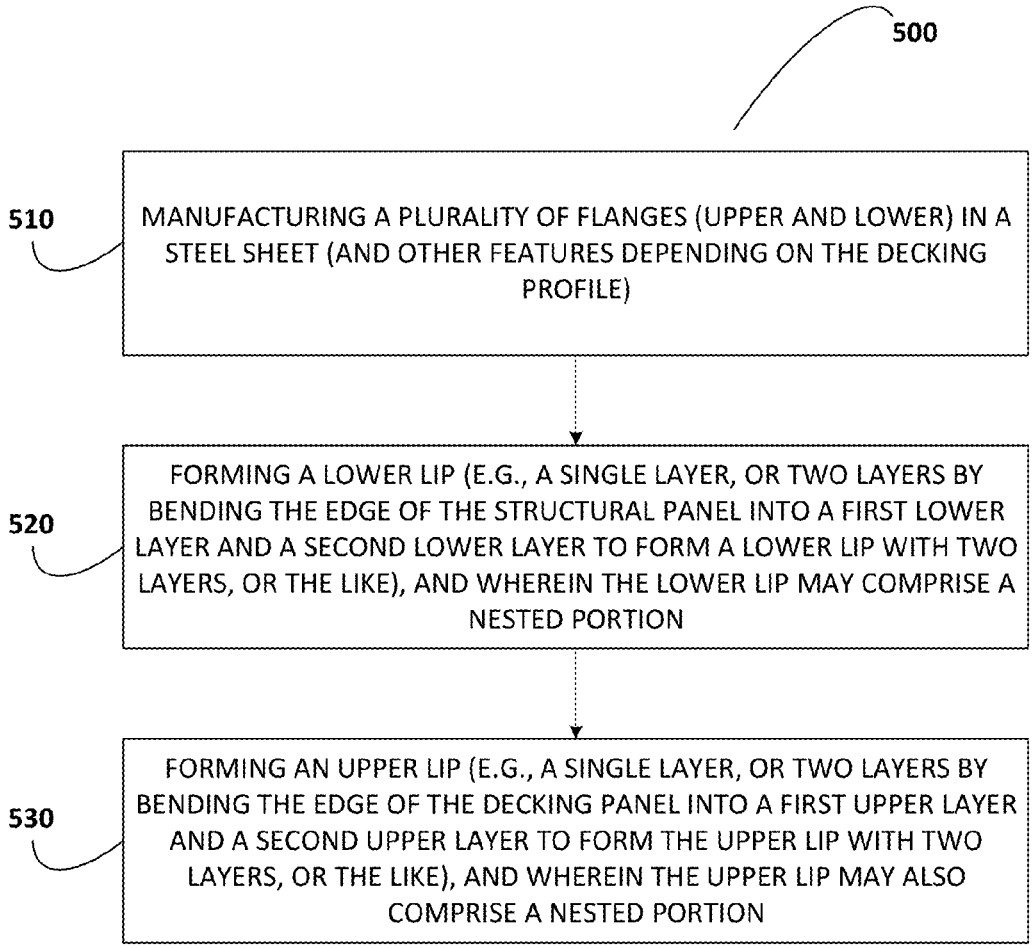
FIG. 15 illustrates a process flow for manufacturing steel structural panels, in accordance with embodiments of the present invention.

FIG. 15 illustrates a process flow 500 for manufacturing steel structural panels 2. At block 510 the process includes forming multiple top flanges 4 and bottom flanges 6 in a steel sheet that has been cut from a coil of steel into the desired length of the structural panel 2. As previously discussed the multiple top flanges 4 and bottom flanges 6 may be formed by roll forming the steel sheet into the desired profile. The height and depth of the top flanges 4 and bottom flanges 6, and edges 8 of the panel, along with the original width of the steel coil determine the ultimate width of the structural panel. As such, the width of the steel coil used to create the structural panels 2 may be determined based on the desired width of the structural panels 2, the height and depth of the top flanges 4 and bottom flanges 6, and the type and width of the edges 8 (e.g., number of layers, width of the sidelap, or the like) of the structural panels 2.

At block 520 the process includes forming a lower lip 10 on at least one edge 8 of the structural panel 2. The lower lip 10 may be formed by bending (or cutting and bending depending on the width of the lower lip 10 and/or the number of layers in the lower lip 10) the edge 8 of the structural panel 2 into a first lower layer 20. When forming a lower lip 10 with two layers the process further includes bending a portion of the first lower layer 20 into a second lower layer 22 that is folded back onto the first lower layer 20, or by using another like process. The bending may be inwardly (e.g., up) or outwardly (e.g., down) depending on the desired configuration of the edge 8. Moreover, the first lower layer 20 and second lower layer 22 may be further bent together in a generally upward angled or curved configuration in order to create the nested portion 11 of the lower lip 10.

At block 530 the process further includes forming an upper lip 12 along at least one edge 8 of the structural panel 2. The upper lip 12 may be formed within the roll forming process by bending (or cutting and bending depending on the width of the upper lip 12 and/or the number of layers in the upper lip 12) the edge 8 into a first upper layer 30 and a second upper layer 32. When forming the upper lip 10 with two layers the process further includes bending a portion of the first upper layer 30 into a second upper layer 32 that is folded back onto the first upper layer 30, or by using another like process. The bending may be inwardly (e.g., up) or outwardly (e.g., down) depending on the desired configuration of the edge 8. Moreover, the first upper layer 30 and second upper layer 32 may be further bent together in a generally upward angled or curved configuration in order to create a nested portion (not illustrated) of the upper lip 10. The upper lip 12 is configured to fit over an adjacent lower lip 10 of an adjacent structural panel 2.

As such, the upper lip 12 and lower lip 10 may be created in one embodiment of the invention by a roll-forming process that shapes the sheets of metal into the desired shapes through one or more rolling stages using one or more rollers that provide the desired shape. As such, in order to create the lower lip 10 in a profile, the top flanges 4 and bottom flanges 6 may first be created by rolling a sheet into the desired profile. A substantially flat partial bottom flange 6 (or top flange 4) may be created at the panel edge 8 during or after the forming of the profile of the top flanges 4 and bottom flanges 6 of the panel 2. The second lower lip layer 22 and the second upper lip layer 32 may be formed during or after forming the top flanges and bottom flanges 6 by bending portions of the panel edges 8 back upon the first lower lip layer 20 and first upper lip layer 30 until the desired shape is formed. A portion of the lower lip 10 and upper lip 12 with the two layers may be further bent to create a nested portion within the lower lip 10 and/or the upper lip 12.

Figure 16:
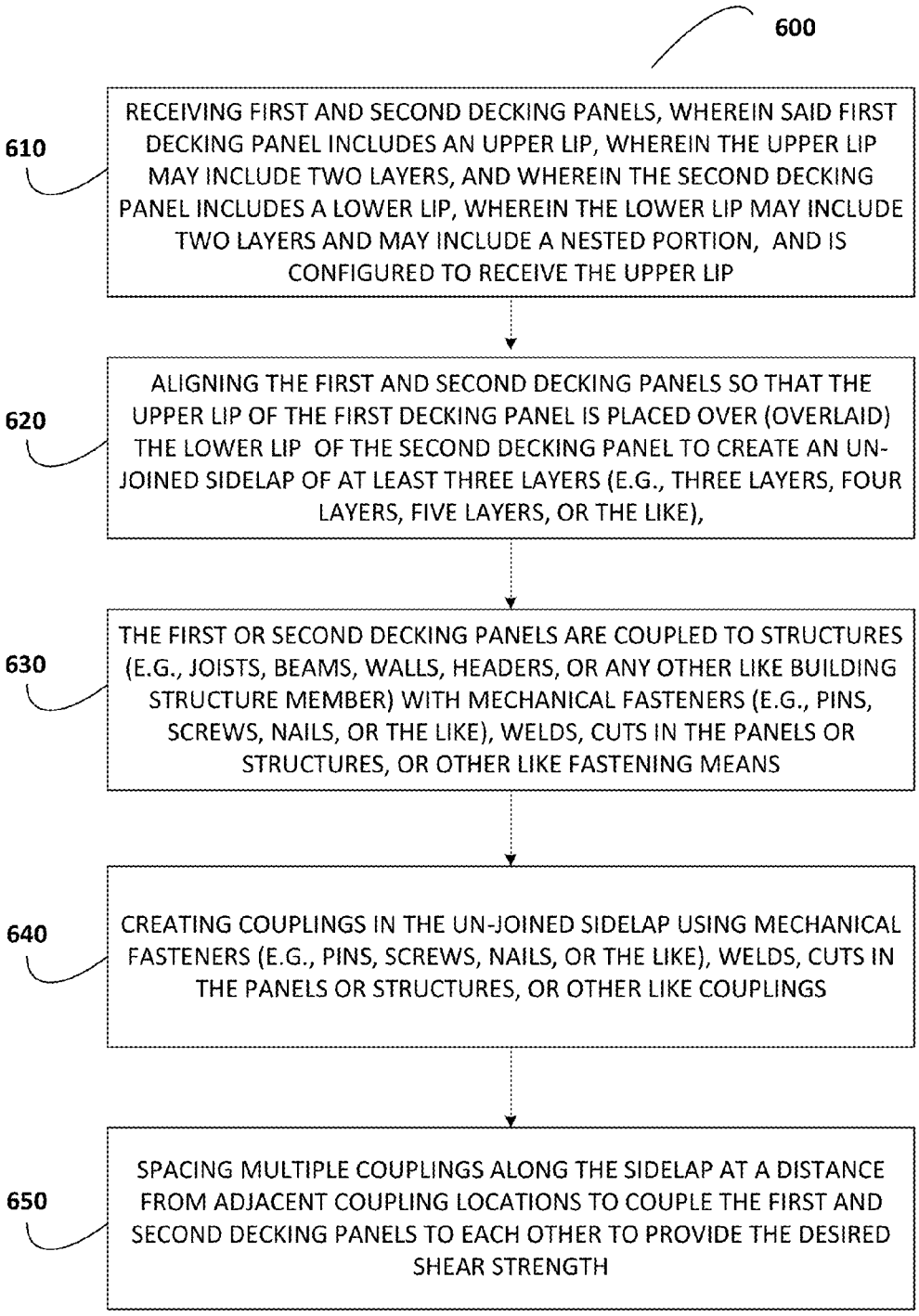
FIG. 16 illustrates a process flow for assembling steel structural panels, in accordance with embodiments of the present invention.

FIG. 16 is a process flow 600 for assembling steel structural panels 2. At block 610 the process includes receiving first and second structural panels 2, wherein said first structural panel 2 includes at least an upper lip 12, and the upper lip 12 may include at least two layers of the structural panel 2. The second structural panel 2 includes at least one lower lip 10, and the lower lip 10 may include at least two layers of the structural panel 2. At block 620 the process includes aligning the first and second structural panels 2 so that the upper lip 12 of the first structural panel 2 is placed over the lower lip 10 of the second structural panel 2 to create an un-joined sidelap 14 of four layers of steel (or another sidelap discussed herein with any number of other layers or different sidelap configurations). In other embodiments of the invention, as previously discussed one of the upper lip 12 or the lower lip 10 may have three layers, while the other has a single layer. In other embodiments, one of the upper lip 12 or lower lip 10 may have two layers, while the other has only one layer. In still other embodiments the sidelap 14 may be formed around a lower flange corner 5. It should be understood that the method described in FIG. 16 may relate to any of the profiles or sidelaps 14 described herein.

Block 630 illustrates that the first and/or second structural panels 2 are operatively coupled to the building structure, such as but not limited through couplings with the joists, beams, walls, headers, or any other like building structure member (e.g., to form a roof, floor, and/or wall system). The couplings between the structural panels 2 and the building structure may be made through the use of mechanical fasteners, welds, cuts in the material, or other like couplings. In some embodiments of the invention, the first and/or second structural panels 2 may be coupled to the building structure before, during, or after the un-joined sidelap 14 is created between adjacent panels 2, or before, during, or after the couplings are formed in the sidelap 14 (e.g., in the four layer sidelap 14).

At block 640 the process includes creating a coupling (e.g., joint, connection, attachment, or the like) at a first location on the sidelap 14. As previously discussed, the coupling may be created by inserting a self-drilling screw (or other like fastener discussed herein) into the sidelap 14, welding the sidelap 14, or cutting substantially through the sidelap 14 at a first location. At block 650 the process includes creating couplings at one or more additional locations along the sidelap 14. As with the coupling at the first location the couplings may be created by utilizing fasteners in the sidelap, welding the sidelap 14, cutting (e.g., shearing, punching, or the like), or through other like means. In some embodiments of the invention, the spacing of the couplings in the sidelap 14 are positioned to create the desired shear strength in the assembled structural system based at least in part on the requirements of the building, the type of couplings used, the thickness of the panels 2, the longitudinal ribs in the panels 2, cutouts in the panels 2, or the like.

As such, in one example a structural panel (e.g., first or second structural panel) with a lower lip 10 is secured to the building structure through one or more couplings, and another structural panel (e.g., first or second structural panel 2) with an upper lip 12 is placed over the lower lip 10, and the second structural panel 2 is secured to the building structure through one or more couplings. Couplings are also formed in the sidelap 14 created by the first structural panel 2 and the second structural panel 2 in order to couple the structural panels 2 to each other. Other structural panels 2 are added, and the couplings are made until the structural system is complete.

In still other embodiments of the invention when the upper lip 12 is placed over the lower lip 10, the sidelap is not joined, and as such one panel may be lifted off of an adjacent panel before they are coupled together. However, in some embodiments of the invention the lower lip 10 (or in some embodiments the upper lip 12) may have a nested portion 11 (e.g., a curved end or other feature) that allows the upper lip 12 to nest into a portion of the edge of the lower lip 10, or vice versa. In these embodiments, the upper lip 12 and the lower lip 10 may be at least partially coupled or nested to prevent a structural panel 2 from moving out-of-plane, or sliding with respect to an adjacent structural panel before the couplings are made. Moreover, while the structural panels 2 may be partially coupled or nested in these embodiments the improvements to the shear strength are not realized without creating the couplings along the sidelap because the panels could still separate transversely or move laterally with respect to each other at the sidelap without the couplings. The nested configuration of the lips 10, 12 of the present invention may provide for easier installation over interlocking sidelap configurations, which may be difficult to assemble together because the interlocking portions may be bent or difficult to interlock together while an installer is standing on floor or roof system, or trying to install the panels 2 in a wall system, especially for panels 2 with long lengths.

In some embodiments of the invention the structural panel system may be inverted in order to use the system as an awning or cover. In this embodiment of the invention the lower lip 10 is on the top surface of the structural system (e.g., may be described as the upper awning lip), and the upper lip 12 becomes the bottom surface of the structural system (e.g., may be described as the lower awning lip). In this configuration the nested portion of the lower lip 10 extends downwardly over the lower flange corner 5 (e.g., may be described as the upper awning flange corner 5). The sidelap 14 may still be operatively coupled together using the couplings described herein. Moreover, in the present invention the nested portion 11 may direct rain or other liquids away from the sidelap 14 and towards an awning lower flange 4, and thus, prevent or reduce the amount of water that may seep into the sidelap 14.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A structural decking panel system, comprising:

a first structural panel comprising first top flanges, first bottom flanges, first webs, and at least one edge of the first structural panel comprising an upper lip, wherein the first top flanges are operatively coupled to the first bottom flanges through the first webs;

a second structural panel comprising second top flanges, second bottom flanges, second webs, and at least one edge of the second structural panel comprising a lower lip, wherein the second top flanges, are operatively coupled to the second bottom flanges through the second webs;

wherein the upper lip of the first structural panel is placed over the lower lip of the second structural panel to create a sidelap with three or more layers, and wherein the sidelap is in a generally in-plane orientation with respect to the first structural panel and the second structural panel; and one or more couplings formed in the three or more layers of the sidelap to couple the first structural panel to the second structural panel.

2. The system of claim 1, wherein the lower lip comprises:

a first lower layer;

a second lower layer; and wherein the second lower layer is folded back upon the first lower layer to form a lower lip with two layers in the in-plane orientation with respect to the second structural panel.

3. The system of claim 2, wherein the second lower layer is folded on top of the first lower layer or folded under the first lower layer.

4. The system of claim 1, wherein the sidelap is a nested sidelap, and wherein the lower lip of the nested sidelap comprises:

a nested portion formed at a distal portion of the lower lip of the second structural panel that extends from the in-plane orientation of a proximate portion of the lower lip;

wherein the nested portion extends around a web of the first webs adjacent the upper lip such that a lower flange corner of the first structural panel rests within the nested portion of the lower lip; and wherein the nested portion of the lower lip of the second structural panel inhibits movement between the first structural panel and the second structural panel of the nested sidelap before the one or more couplings are formed in the nested sidelap.

5. The system of claim 1, wherein the upper lip comprises:

a first upper layer;

a second upper layer; and wherein the second upper layer is folded back upon the first upper layer to form an upper lip with two layers in the in-plane orientation with respect to the first structural panel.

6. The system of claim 5, wherein the second upper layer is folded on top of the first upper layer or folded under the first upper layer.

7. The system of claim 1, wherein the sidelap formed from the upper lip placed over the lower lip forms a sidelap with four or more layers; and wherein the one or more couplings are formed in the four or more layers of the sidelap.

8. The system of claim 1, wherein the one or more couplings are fasteners that operatively couple the upper lip to the lower lip.

9. The system of claim 1, wherein the one or more couplings are formed by welding the upper lip to the lower lip, or by cutting the upper lip and lower lip to operatively couple the upper lip to the lower lip.

10. The system of claim 1, wherein the upper lip is formed at least partially along a web of the first webs and is bent at a lower flange corner in the in-plane orientation with respect to the first structural panel to form an in-plane edge of the first structural panel, and wherein the lower lip is formed at least partially along an edge of the second structural panel in the in-plane orientation with respect to the second structural panel and is bent upwardly in order to receive the upper lip formed along the web, the lower flange corner, and the in-plane edge of the first structural panel.

11. The system of claim 1, wherein the one or more couplings in the sidelap with the three or more layers improves the shear strength of the sidelap by greater than a factor of 1.05 over a sidelap with two layers.

12. The system of claim 1, wherein the one or more couplings in the sidelap with the three or more layers results in a shear strength that is the same as or similar to a sidelap with two layers with at least 5 percent fewer couplings in the sidelap with the three or more layers.

13. The system of claim 1, wherein the one or more couplings in the sidelap with the three or more layers results in a shear strength that is the same as or similar to a two layer sidelap with a material thickness of the first or second structural panels that is at least 5 percent thinner than the two layer sidelap structural panel thickness.

14. The system of claim 1, wherein the first panel and the second panel of the structural panel system has a first material thickness, a first number of couplings from the one or more couplings, and a first shear strength that is the same or similar to a second shear strength of a second structural panel system utilizing a two layer sidelap having a second material thickness greater than the first material thickness and a second number of couplings greater than the first number of couplings when a length and a width of the structural panel system is the same as the second structural panel system.

15. A structural decking panel system, comprising:

a first structural panel comprising first top flanges, first bottom flanges, first webs, and at least one edge comprising an upper lip, wherein the first top flanges are operatively coupled to the first bottom flanges through the first webs;

a second structural panel comprising second top flanges, second bottom flanges, second webs, and at least one edge comprising a lower lip having a nested portion formed at a distal portion of the lower lip that extends from a generally in-plane orientation of a proximate portion of the lower lip, wherein the second top flanges are operatively coupled to the second bottom flanges through the second webs;

wherein the upper lip of the first structural panel is placed over the lower lip of the second structural panel to create a nested sidelap with three or more layers, wherein the nested sidelap comprises the nested portion of the lower lip that extends around a web adjacent the upper lip such that a lower flange corner of the first structural panel rests within the nested portion of the lower lip, and wherein the lower lip and the upper lip are in the in-plane orientation with respect to the first structural panel and the second structural panel; and one or more couplings formed in the three or more layers of the nested sidelap to couple the first structural panel to the second structural panel.

16. The system of claim 15, wherein the nested sidelap comprises four or more layers and wherein the lower lip comprises:

a first lower layer;

a second lower layer; and wherein the second lower layer is folded back upon the first lower layer to form a lower lip with two layers in the in-plane orientation with respect to the second structural panel; and wherein the upper lip comprises:

a first upper layer;

a second upper layer; and wherein the second upper layer is folded back upon the first upper layer to form an upper lip with two layers in the in-plane orientation with respect to the first structural panel.

17. The system of claim 15, wherein the nested portion of the lower lip of the nested sidelap inhibits movement between the first structural panel and the second structural panel of the nested sidelap before the one or more couplings are formed in the nested sidelap.

18. The system of claim 15, wherein the upper lip is formed at least partially along a web of the first webs and is bent at a lower flange corner in the in-plane orientation with respect to the first structural panel to form an in-plane edge of the first structural panel, and wherein the lower lip is formed at least partially along an edge of the second structural panel in the in-plane orientation with respect to the second structural panel and is bent upwardly in order to receive the upper lip formed along the web, the lower flange corner, and the in-plane edge of the first structural panel.

* * * * *